US010892547B2

(12) United States Patent
Rakib et al.

(10) Patent No.: US 10,892,547 B2
(45) Date of Patent: Jan. 12, 2021

(54) INCONSPICUOUS MULTI-DIRECTIONAL ANTENNA SYSTEM CONFIGURED FOR MULTIPLE POLARIZATION MODES

(71) Applicant: Cohere Technologies, Inc., Santa Clara, CA (US)

(72) Inventors: Shlomo Selim Rakib, Saratoga, CA (US); Ronny Hadani, Austin, TX (US)

(73) Assignee: Cohere Technologies, Inc., Santa Clara, CA (US)

( * ) Notice: Subject to any disclaimer, the term of this patent is extended or adjusted under 35 U.S.C. 154(b) by 714 days.

(21) Appl. No.: 15/203,728

(22) Filed: Jul. 6, 2016

(65) Prior Publication Data

US 2017/0040711 A1 Feb. 9, 2017

Related U.S. Application Data

(60) Provisional application No. 62/189,541, filed on Jul. 7, 2015.

(51) Int. Cl.
*H01Q 1/44* (2006.01)
*H01Q 1/24* (2006.01)
(Continued)

(52) U.S. Cl.
CPC ..... *H01Q 1/44* (2013.01); *H01Q 1/1271* (2013.01); *H01Q 1/246* (2013.01);
(Continued)

(58) Field of Classification Search
CPC .... H01Q 25/001; H01Q 25/002; H01Q 1/007; H01Q 1/1271; H01Q 1/1285;
(Continued)

(56) References Cited

U.S. PATENT DOCUMENTS 4,754,493 A 6/1988 Coates
5,083,135 A 1/1992 Nagy et al.
(Continued)

FOREIGN PATENT DOCUMENTS

EP 1432168 A1 6/2004
EP 3314836 A1 5/2018
(Continued)

OTHER PUBLICATIONS

Office Action for U.S. Appl. No. 13/117,119, dated Aug. 5, 2013.
(Continued)

*Primary Examiner* — Robert Karacsony
(74) *Attorney, Agent, or Firm* — Cooley LLP

(57) ABSTRACT

Inconspicuous antenna systems configured to include substantially transparent conducting and dielectric materials or open lattice structures. The antenna systems are capable of distinguishing wireless waveforms over a plurality of different polarization states and directions. Polarized antenna elements are assembled into antenna sets, each set with a different directionality. The different directionality sets in turn form the antenna system. Directionality can be achieved by employing different printed antenna like designs, variable length microstrips, Rotman lenses, active phase adjust, metamaterials, and other methods. The antenna system can be widely used in urban environments and installed as visually inconspicuous retrofits over building windows, street lights, air conditioning units, and the like.

26 Claims, 18 Drawing Sheets

(51) Int. Cl.

| | |
|---|---|
| ***H01Q 25/00*** | (2006.01) |
| ***H01Q 9/04*** | (2006.01) |
| ***H01Q 1/12*** | (2006.01) |
| *H01Q 13/08* | (2006.01) |
| *H01Q 19/30* | (2006.01) |

(52) U.S. Cl.
CPC ..... *H01Q 9/0407* (2013.01); *H01Q 25/001* (2013.01); *H01Q 9/0457* (2013.01); *H01Q 13/085* (2013.01); *H01Q 19/30* (2013.01)

(58) Field of Classification Search
CPC ..... H01Q 1/246; H01Q 1/38; H01Q 1/44; H01Q 9/0407; H01Q 9/045; H01Q 9/0457; H01Q 13/085; H01Q 19/30; H01Q 21/065; H01Q 21/24; H01Q 21/28
See application file for complete search history.

(56) References Cited

U.S. PATENT DOCUMENTS 5,182,642 A 1/1993 Gersdorff et al.
5,623,511 A 4/1997 Bar-David et al.
5,831,977 A 11/1998 Dent
5,872,542 A 2/1999 Simons et al.
5,956,624 A 9/1999 Hunsinger et al.
6,212,246 B1 4/2001 Hendrickson
6,289,063 B1 9/2001 Duxbury
6,356,555 B1 3/2002 Rakib et al.
6,388,621 B1 * 5/2002 Lynch ..... H01Q 1/125 343/700 MS
6,426,983 B1 7/2002 Rakib et al.
6,608,864 B1 8/2003 Strait
6,631,168 B2 10/2003 Izumi
6,704,366 B1 3/2004 Combes et al.
7,327,812 B2 2/2008 Auer
7,773,685 B2 8/2010 Tirkkonen et al.
7,864,877 B2 1/2011 Hottinen
8,229,017 B1 7/2012 Lee et al.
8,259,845 B2 9/2012 Dent
8,401,131 B2 3/2013 Fety et al.
8,547,988 B2 10/2013 Hadani et al.
8,619,892 B2 12/2013 Vetter et al.
8,879,378 B2 11/2014 Rakib et al.
8,892,048 B1 11/2014 Turner
8,976,851 B2 3/2015 Hadani et al.
9,031,141 B2 5/2015 Hadani et al.
9,071,285 B2 6/2015 Hadani et al.
9,071,286 B2 6/2015 Hadani et al.
9,083,483 B1 7/2015 Rakib et al.
9,083,595 B2 7/2015 Rakib et al.
9,130,638 B2 9/2015 Hadani et al.
9,282,528 B2 3/2016 Hashimoto
9,294,315 B2 3/2016 Hadani et al.
9,444,514 B2 9/2016 Hadani et al.
9,548,840 B2 1/2017 Hadani et al.
9,553,984 B2 1/2017 Krause et al.
9,590,779 B2 3/2017 Hadani et al.
9,634,719 B2 4/2017 Rakib et al.
9,660,851 B2 5/2017 Hadani et al.
9,668,148 B2 5/2017 Hadani et al.
9,712,354 B2 7/2017 Hadani et al.
10,090,972 B2 10/2018 Hadani et al.
10,090,973 B2 10/2018 Hadani et al.
10,341,155 B2 7/2019 Hadani et al.
10,411,843 B2 9/2019 Rakib et al.
10,469,215 B2 11/2019 Rakib et al.
10,476,564 B2 11/2019 Hadani et al.
2001/0031022 A1 10/2001 Petrus et al.
2001/0033614 A1 10/2001 Hudson
2001/0046205 A1 11/2001 Easton et al.
2002/0001308 A1 1/2002 Heuer
2002/0034191 A1 3/2002 Shattil
2002/0181388 A1 12/2002 Jain et al.
2002/0181390 A1 12/2002 Mody et al.
2002/0181607 A1 12/2002 Izumi
2003/0073464 A1 4/2003 Giannakis et al.
2004/0044715 A1 3/2004 Aldroubi et al.
2004/0189581 A1 9/2004 Sako et al.
2004/0218523 A1 11/2004 Varshney et al.
2005/0157778 A1 7/2005 Trachewsky et al.
2005/0207334 A1 9/2005 Hadad
2005/0251844 A1 11/2005 Martone et al.
2006/0008021 A1 1/2006 Bonnet
2006/0039270 A1 2/2006 Strohmer et al.
2007/0014272 A1 1/2007 Palanki et al.
2007/0038691 A1 2/2007 Candes et al.
2007/0078661 A1 4/2007 Sriram et al.
2007/0104283 A1 5/2007 Han et al.
2007/0110131 A1 5/2007 Guess et al.
2007/0211952 A1 9/2007 Faber et al.
2007/0253465 A1 11/2007 Muharemovic et al.
2008/0043857 A1 2/2008 Dias et al.
2008/0117999 A1 5/2008 Kadous et al.
2008/0186843 A1 8/2008 Ma et al.
2008/0187062 A1 8/2008 Pan et al.
2008/0232504 A1 9/2008 Ma et al.
2008/0273624 A1 11/2008 Kent et al.
2008/0310383 A1 12/2008 Kowalski
2009/0080403 A1 3/2009 Hamdi
2009/0092259 A1 4/2009 Jot et al.
2009/0103593 A1 4/2009 Bergamo
2009/0122854 A1 5/2009 Zhu et al.
2009/0161804 A1 6/2009 Chrabieh et al.
2009/0204627 A1 8/2009 Hadani
2009/0222226 A1 9/2009 Baraniuk et al.
2009/0303961 A1 12/2009 Popovic et al.
2010/0008432 A1 1/2010 Kim et al.
2010/0027608 A1 2/2010 Priotti
2010/0073232 A1 * 3/2010 Sajuyigbe ..... H01Q 19/025 342/372
2010/0111138 A1 5/2010 Hosur et al.
2010/0142476 A1 6/2010 Jiang et al.
2010/0187914 A1 7/2010 Rada et al.
2010/0238787 A1 9/2010 Guey
2010/0277308 A1 11/2010 Potkonjak
2010/0303136 A1 12/2010 Ashikhmin et al.
2010/0322349 A1 12/2010 Lee et al.
2011/0007789 A1 1/2011 Garmany
2011/0110532 A1 5/2011 Svendsen
2011/0116489 A1 5/2011 Grandhi
2011/0116516 A1 5/2011 Hwang et al.
2011/0126071 A1 5/2011 Han et al.
2011/0131463 A1 6/2011 Gunnam
2011/0216808 A1 9/2011 Tong et al.
2011/0286502 A1 11/2011 Adachi et al.
2011/0287778 A1 11/2011 Levin et al.
2011/0292971 A1 12/2011 Hadani et al.
2011/0293030 A1 12/2011 Rakib et al.
2011/0299379 A1 12/2011 Sesia et al.
2011/0305267 A1 12/2011 Rius et al.
2012/0021769 A1 1/2012 Lindoff et al.
2012/0045995 A1 2/2012 Nakano et al.
2012/0051457 A1 3/2012 Ma et al.
2012/0140716 A1 6/2012 Baldemair et al.
2012/0170684 A1 7/2012 Yim et al.
2012/0201322 A1 8/2012 Rakib et al.
2012/0213098 A1 8/2012 Sun
2012/0235795 A1 9/2012 Liao et al.
2012/0306685 A1 12/2012 Asanuma et al.
2012/0320994 A1 12/2012 Loghin et al.
2013/0058390 A1 3/2013 Haas et al.
2013/0077579 A1 3/2013 Cho et al.
2013/0083661 A1 4/2013 Gupta et al.
2013/0121497 A1 5/2013 Smaragdis et al.
2013/0230010 A1 9/2013 Kim et al.
2013/0260787 A1 10/2013 Hashimoto
2013/0279627 A1 10/2013 Wu et al.
2014/0143639 A1 5/2014 Loghin et al.
2014/0161154 A1 6/2014 Hadani et al.
2014/0169385 A1 6/2014 Hadani et al.
2014/0169406 A1 6/2014 Hadani et al.
2014/0169433 A1 6/2014 Hadani et al.
2014/0169436 A1 6/2014 Hadani et al.

(56) References Cited

U.S. PATENT DOCUMENTS

| | | | |
|---|---|---|---|
| 2014/0169437 | A1 | 6/2014 | Hadani et al. |
| 2014/0169441 | A1 | 6/2014 | Hadani et al. |
| 2014/0177751 | A1 | 6/2014 | Tomeba et al. |
| 2014/0247803 | A1 | 9/2014 | Arambepola et al. |
| 2014/0348252 | A1 | 11/2014 | Siohan et al. |
| 2014/0364128 | A1 | 12/2014 | Lee et al. |
| 2015/0117395 | A1 | 4/2015 | Hadani et al. |
| 2015/0326273 | A1 | 11/2015 | Rakib et al. |
| 2015/0327085 | A1 | 11/2015 | Hadani et al. |
| 2015/0382231 | A1 | 12/2015 | Jabbar et al. |
| 2016/0043835 | A1 | 2/2016 | Hadani et al. |
| 2016/0135132 | A1 | 5/2016 | Donepudi et al. |
| 2016/0182269 | A1 | 6/2016 | Hadani et al. |
| 2016/0191217 | A1 | 6/2016 | Hadani et al. |
| 2016/0191280 | A1 | 6/2016 | Hadani et al. |
| 2016/0277225 | A1 | 9/2016 | Frenne et al. |
| 2016/0309345 | A1 | 10/2016 | Tehrani et al. |
| 2016/0380743 | A1 | 12/2016 | Rakib |
| 2016/0381576 | A1 | 12/2016 | Hadani et al. |
| 2017/0012749 | A1 | 1/2017 | Rakib et al. |
| 2017/0012810 | A1 | 1/2017 | Rakib et al. |
| 2017/0019297 | A1 | 1/2017 | Rakib |
| 2017/0033899 | A1 | 2/2017 | Rakib et al. |
| 2017/0078054 | A1 | 3/2017 | Hadani et al. |
| 2017/0099122 | A1 | 4/2017 | Hadani et al. |
| 2017/0099607 | A1 | 4/2017 | Hadani et al. |
| 2017/0149594 | A1 | 5/2017 | Rakib |
| 2017/0149595 | A1 | 5/2017 | Rakib et al. |
| 2017/0201354 | A1 | 7/2017 | Hadani et al. |

FOREIGN PATENT DOCUMENTS

| | | | |
|---|---|---|---|
| EP | 3378187 | A1 | 9/2018 |
| EP | 2865153 | B1 | 12/2018 |
| JP | 2005-528814 | A | 9/2005 |
| JP | 2008-544602 | A | 12/2008 |
| JP | 2011-127910 | | 6/2011 |
| JP | 2014-150469 | A | 8/2014 |
| WO | WO-03/028400 | A1 | 4/2003 |
| WO | WO-2006/132589 | A2 | 12/2006 |
| WO | WO 2007/004297 | | 1/2007 |
| WO | WO 2011/137699 | A1 | 11/2011 |
| WO | WO 2011/150315 | A3 | 12/2011 |
| WO | WO 2013/148546 | A1 | 10/2013 |
| WO | WO 2014/004585 | | 1/2014 |
| WO | WO 2016/014596 | | 1/2016 |
| WO | WO 2016/014598 | | 1/2016 |
| WO | WO 2016/176642 | | 11/2016 |
| WO | WO 2016/183230 | | 11/2016 |
| WO | WO 2016/183240 | | 11/2016 |
| WO | WO 2016/209848 | | 12/2016 |
| WO | WO 2017/003952 | | 1/2017 |
| WO | WO 2017/011478 | | 1/2017 |

OTHER PUBLICATIONS

Notice of Allowance for U.S. Appl. No. 13/117,119, dated Feb. 28, 2014.
International Search Report and Written Opinion for International Application No. PCT/US2011/038302, dated Nov. 15, 2011.
International Preliminary Report on Patentability for International Application No. PCT/US2011/038302, dated Jun. 4, 2012.
Office Action for U.S. Appl. No. 13/117,124, dated Feb. 22, 2013.
Notice of Allowance for U.S. Appl. No. 13/117,124 dated Aug. 8, 2013.
Examination Report for Australian Application No. 2013280487, dated May 2, 2016.
Supplementary European Search Report for European Application No. 13809004.8, dated Apr. 14, 2016, 8 pages.
Office Action for Japanese Application No. 2015-518647, dated Jul. 7, 2015, 10 pages.
Notice of Allowance for U.S. Appl. No. 13/927,087, dated Feb. 25, 2015.
Office Action for U.S. Appl. No. 13/927,087, dated Nov. 12, 2014.
International Search Report and Written Opinion for International Application No. PCT/US2013/047723 dated Oct. 29, 2013.
International Preliminary Report on Patentability for International Application No. PCT/US2013/047723 dated Dec. 31, 2014.
Notice of Allowance for U.S. Appl. No. 13/927,088, dated Feb. 18, 2015.
Office Action for U.S. Appl. No. 13/927,088, dated Nov. 28, 2014.
Notice of Allowance for U.S. Appl. No. 13/927,086, dated Dec. 26, 2014.
Notice of Allowance for U.S. Appl. No. 13/927,086, dated Mar. 19, 2015.
Office Action for U.S. Appl. No. 13/927,086, dated Oct. 14, 2014.
Office Action for U.S. Appl. No. 13/927,089, dated Dec. 24, 2014.
Office Action for U.S. Appl. No. 13/927,089, dated Aug. 14, 2015, 7 pages.
Supplemental Notice of Allowability for U.S. Appl. No. 13/927,091 dated Jun. 11, 2015.
Notice of Allowance for U.S. Appl. No. 13/927,091 dated Apr. 24, 2015.
Office Action for U.S. Appl. No. 13/927,091 dated Jan. 27, 2015.
Office Action for U.S. Appl. No. 13/927,092 dated Oct. 8, 2014.
Notice of Allowance for U.S. Appl. No. 13/927,092 dated Oct. 24, 2014.
Office Action fpr U.S. Appl. No. 13/927,095, dated Apr. 30, 2015, 11 pages.
Office Action fpr U.S. Appl. No. 13/927,095, dated Nov. 4, 2015, 9 pages.
Office Action for U.S. Appl. No. 13/927,095, dated Jun. 1, 2016, 10 pages.
Office Action for U.S. Appl. No. 14/717,886, dated Apr. 19, 2016, 10 pages.
Office Action for U.S. Appl. No. 14/709,377, dated Dec. 11, 2015, 12 pages.
Office Action for U.S. Appl. No. 14/709,377, dated Jul. 13, 2016, 17 pages.
Office Action for U.S. Appl. No. 14/754,596, dated Apr. 19, 2016, 18 pages.
Office Action for U.S. Appl. No. 14/809,129, dated Jul. 19, 2016, 5 pages.
Patent Examination Report No. 1 for Australian Application No. 2013239970, dated Dec. 8, 2015, 3 pages.
Supplementary European Search Report for European Application No. 13768150.8, dated Oct. 30, 2015, 7 pages.
International Search Report and Written Opinion for International Application No. PCT/US2013/033652, dated Jun. 12, 2013.
"AT&T Investor Report," 2014. [Online]. Available: http://www.att.com/Investor/ATT_Annual/2014/att_introduces_new_concepts_for_telecom_network.html.
Banelli, P. et al., "Modulation Formats and Waveforms for 5G Networks: Who Will Be the Heir of OFDM?," IEEE Signal Processing Magazine, pp. 80-93, 2014.
Catt, "UL ACKINACK transmission methods for LTE-A", 3GPP Draft; RAN WG1 R1-102453, Apr. 7, 2010 (Apr. 7, 2010), Beijing, China, XP050419703.
Gurevich et al. "Group Representation Design of Digital Signals and Sequences", S.W. Golomb et al. (Eds.): SETA2008, LNCS 5203, pp. 153-166 (2008).
Holma, H. et al., "LTE for UMTS-OFDMA and SCFDMA Based Radio Access". Jan. 1, 2009 (Jan. 1, 2009 ), John Wiley & Sons, United Kingdom, XP002728837. See pp. 83-135.
Mecklenbrauker, W., "A Tutorial on Non-Parametric Bilinear Time-Frequency Signal Representations," Time and Frequency Representation of Signals and Systems (Eds. G Longo and B. Picinbono), vol. 309, pp. 11-68, 1989.
Nehorai et al., "MURI: Adaptive waveform design for full spectral dominance," [online], Mar. 11, 2011 [Retrieved on May 11, 2013, Retrieved from the Internet <URL: http://oai.dtic.mil/oai/oai?verb=getRecord&metadataPrefix=html&identifier=ADA565420>.
Rachid, J. E. et al., "NGMN 5G Initiative White Paper," Feb. 17, 2015. [Online]. Available: https://www.ngmn.org/uploads/media/NGMN_5G_White_Paper_V1_0.pdf.

(56) References Cited

OTHER PUBLICATIONS

Rusek, F. et al., "Scaling Up MIMO, Opportunities and Challenges with Very Large Arrays," IEEE Signal Processing Magazine, pp. 40-60, 2013.
Vodafone, "Cellular Internet of Things: Architectural Aspects," in 3GPP RAN#68, Malmo, Sweden, 2015.
International Search Report and Written Opinion for International Application No. PCT/US2016/030259, dated Aug. 4, 2016, 13 pages.
International Search Report and Written Opinion for International Application No. PCT/US2016/031928, dated Oct. 7, 2016, 10 pages.
Supplementary European Search Report for European Application No. 11787483.4, dated Sep. 9, 2014, 6 pages.
Communication Pursuant to Article 94(3) EPC for European Application No. 13809004.8, dated Feb. 17, 2017, 5 pages.
International Search Report and Written Opinion for International Application No. PCT/US2016/050825, dated Feb. 8, 2017, 12 pages.
International Search Report and Written Opinion for International Application No. PCT/US2016/052524, dated Dec. 20, 2016, 8 pages.
International Search Report and Written Opinion for International Application No. PCT/US2016/038584, dated Sep. 26, 2016, 8 pages.
Office Action for U.S. Appl. No. 15/187,668, dated Feb. 16, 2017, 6 pages.
International Search Report and Written Opinion for International Application No. PCT/US2016/031909, dated Aug. 11, 2016, 13 pages.
International Search Report and Written Opinion for International Application No. PCT/US2016/039662, dated Nov. 29, 2016, 14 pages.
International Search Report and Written Opinion for International Application No. PCT/US2016/041940, dated Oct. 20, 2016, 8 pages.
International Search Report and Written Opinion for International Application No. PCT/US2015/041417, dated Oct. 1, 2015, 7 pages.
Office Action for U.S. Appl. No. 14/805,407, dated Dec. 14, 2016, 7 pages.
International Search Report and Written Opinion for International Application No. PCT/US2015/041420, dated Oct. 1, 2015, 6 pages.
Office Action for U.S. Appl. No. 14/605,957, dated Jun. 22, 2017, 6 pages.
International Search Report and Written Opinion for International Application No. PCT/US2017/025797, dated Jun. 21, 2017, 6 pages.
Office Action for U.S. Appl. No. 15/152,464, dated Apr. 6, 2017, 10 pages.
Office Action for U.S. Appl. No. 15/188,946, dated May 8, 2017, 14 pages.
Office Action for U.S. Appl. No. 15/194,494, dated May 5, 2017, 16 pages.
Office Action for U.S. Appl. No. 15/436,653, dated Jun. 2, 2017, 10 pages.
Office Action for U.S. Appl. No. 15/617,962, dated Aug. 14, 2018, 12 pages.
Berger, C. R. et al. (2008) "Compressed Sensing for OFDM/MIMO Radar", IEEE, pp. 213-217.
Office Action for U.S. Appl. No. 15/143,323, dated Dec. 4, 2018, 27 pages.
Extended European Search Report for European Application No. 16787273.8, dated Nov. 26, 2018, 10 pages.
Wunder, G. et al., "Sparse Signal Processing Concepts for Efficient 5G System Design", IEEE Access, vol. 3, pp. 195-208, Mar. 31, 2015, 14 pages.
Cohere Technologies, "5G Air Interface Waveforms", 3GPP RAN workshop on 5G; RWS-150034; Phoenix, USA, Sep. 17-18, 2015, 10 pages.
Extended European Search Report for European Application No. 16793474.4, dated Dec. 19, 2018, 7 pages.
Extended European Search Report for European Application No. 16825056.1, dated Jan. 24, 2019, 11 pages.
Cohere Technologies et al: "OTFS Modulation Waveform and Reference Signals for New RAT", 3GPP Draft; R1-163619 OTFS Waveform for New RAT, 3rd Generation Partnership Project (3GPP), Mobile Competence Centre; 650, Route Des Lucioles ; F-06921 Sophia-Antipolis Cedex; France vol. RAN WG1, No. Busan, South Korea; Apr. 15, 2016, Apr. 18, 2016, XP051090363, Retrieved from the Internet: URL:http://www.3gpp.org/ftp/tsg_ran/WG1RI-I /TSGRI 84b/Docs/ [retrieved on Apr. 18, 2016].
Notice of Allowance for U.S. Appl. No. 15/601,959, dated Feb. 13, 2019, 7 pages.
Office Action issued for Chinese Patent Application No. 201680050535.7 dated Feb. 19, 2019, 13 pages.
Extended European Search Report for European Application No. 16815159.5, dated Feb. 20, 2019, 9 pages.
Extended European Search Report for European Application No. 16818557.7, dated Feb. 20, 2019, 9 pages.
Extended European Search Report for European Application No. 16845070.8, dated Mar. 18, 2019, 10 pages.
Extended European Search Report for European Application No. 15825399.7, dated Jul. 5, 2019, 5 pages.
Final Office Action for U.S. Appl. No. 15/617,962, dated Apr. 8, 2019, 12 pages.
Notice of Allowance for U.S. Appl. No. 15/208,545, dated Apr. 24, 2019, 9 pages.
Yingnan, L. et al. "Estimation of Basis Expansion Models for doubly selective channels", Journal of Electronics (China), Jan. 1, 2008. 25(1): 115-9.
Coleri, S. et al. "Channel estimation techniques based on pilot arrangement in OFDM systems", IEEE Transactions on Broadcasting, Sep. 2002. 48(3): 223-9.
Office Action issued for Chinese Patent Application No. 201580049201.3 dated Jun. 26, 2019, 8 pages (Translation included).
Ito, N. et al. "Pilot-Assisted Channel Estimation for OFDM Systems in Time-Varying Multipath Channels". IEEE Vehicular Technology Conference. The Proceedings of the 36th Symposium on Information Theory and Its Applications. 2013: 116-121.
Nouda, Y. et al. "A study on channel estimation for single carrier block transmission with spare pilot symbols", Collected Papers of General Conference 2012 of The Institute of Electronics, Information and Communication Engineers, 2012. 1:419.
Office Action issued for Japanese Patent Application No. 2017-503561 dated Jun. 26, 2019, 10 pages.
Extended European Search Report for European Application No. 17776920.5, dated Sep. 23, 2019, 9 pages.
Garcia-Rodriguez, A. et al. "Optimizing interference as a source of signal energy with non-linear precoding", 2014 International Wireless Communications and Mobile Computing Conference (IWCMC), IEEE: 809-814 (Aug. 4, 2014).

* cited by examiner

Figure 5A
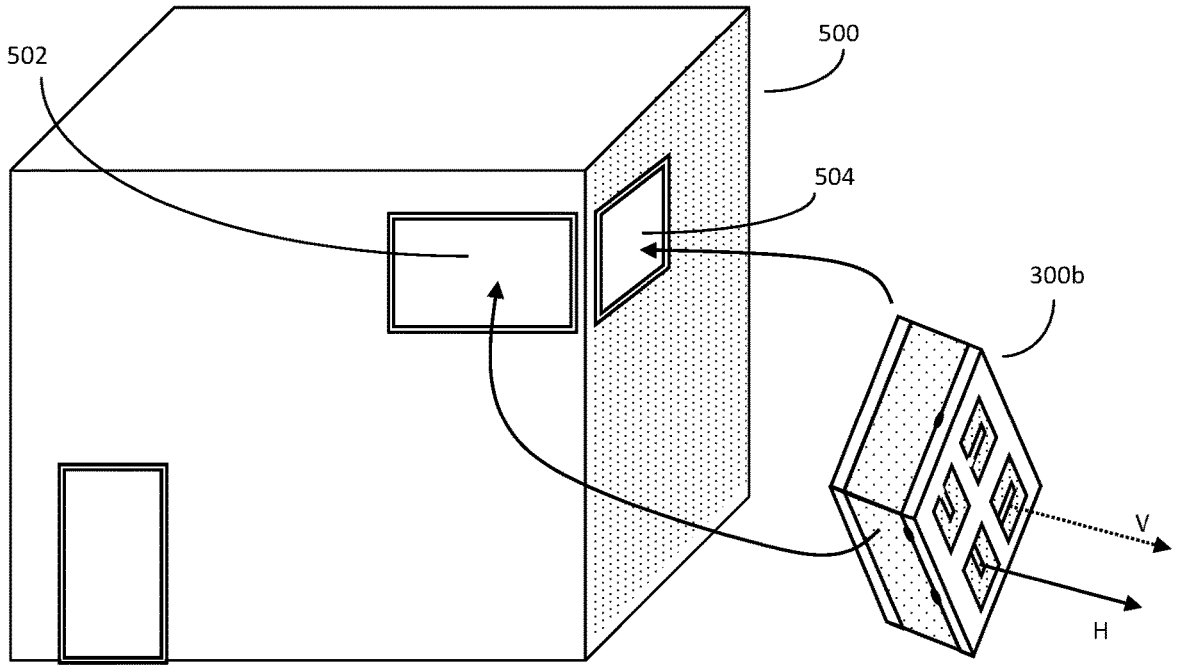
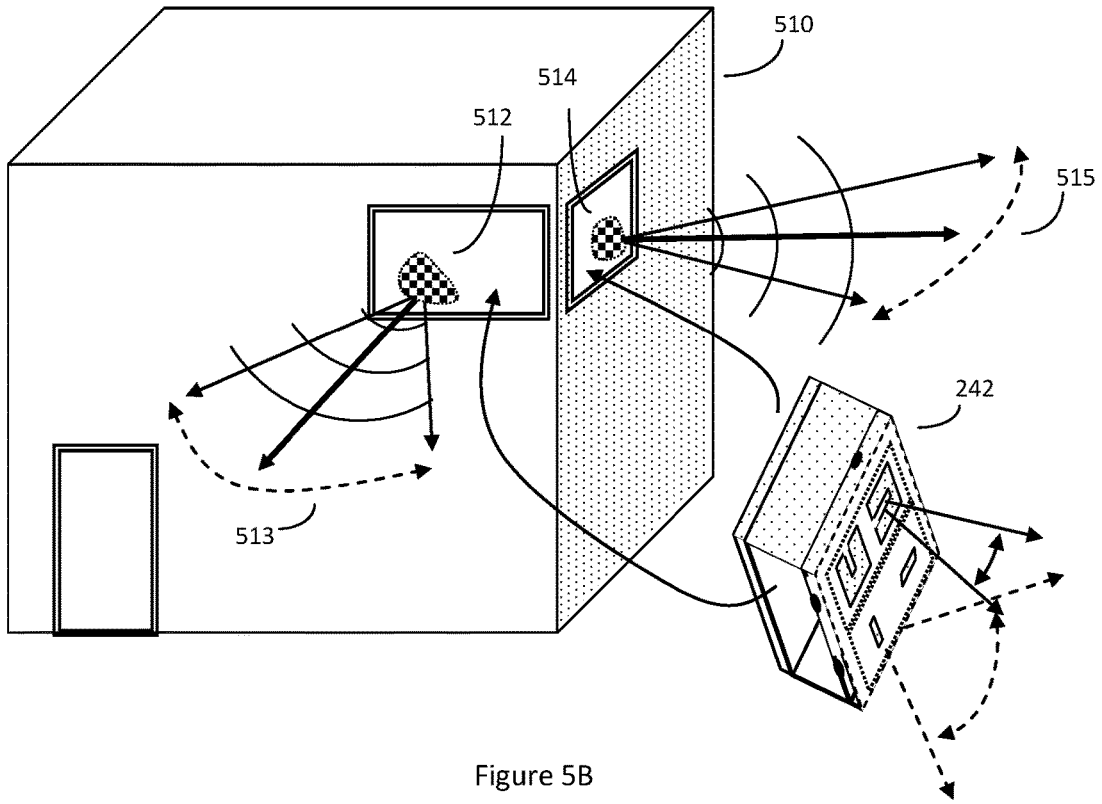
Figure 5B

Figure 8A
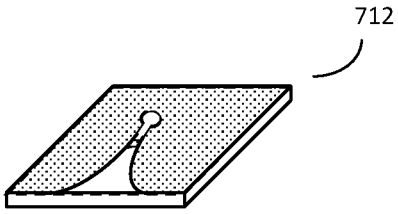
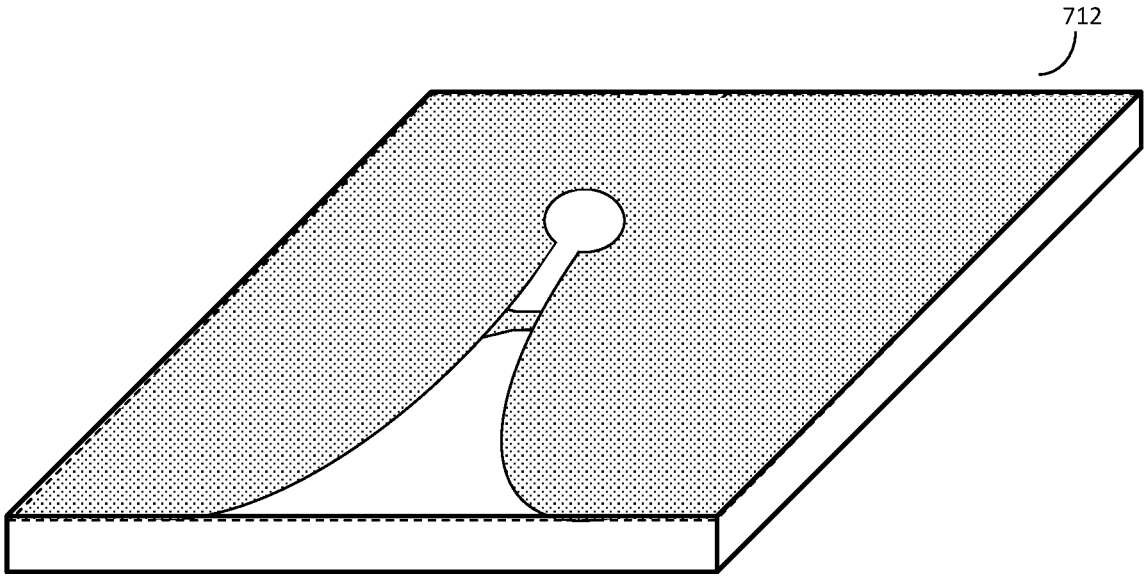
Figure 8B

Figure 10A
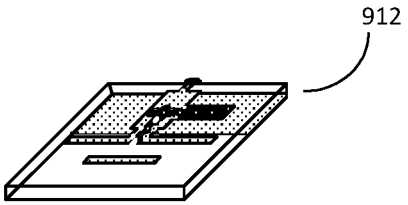
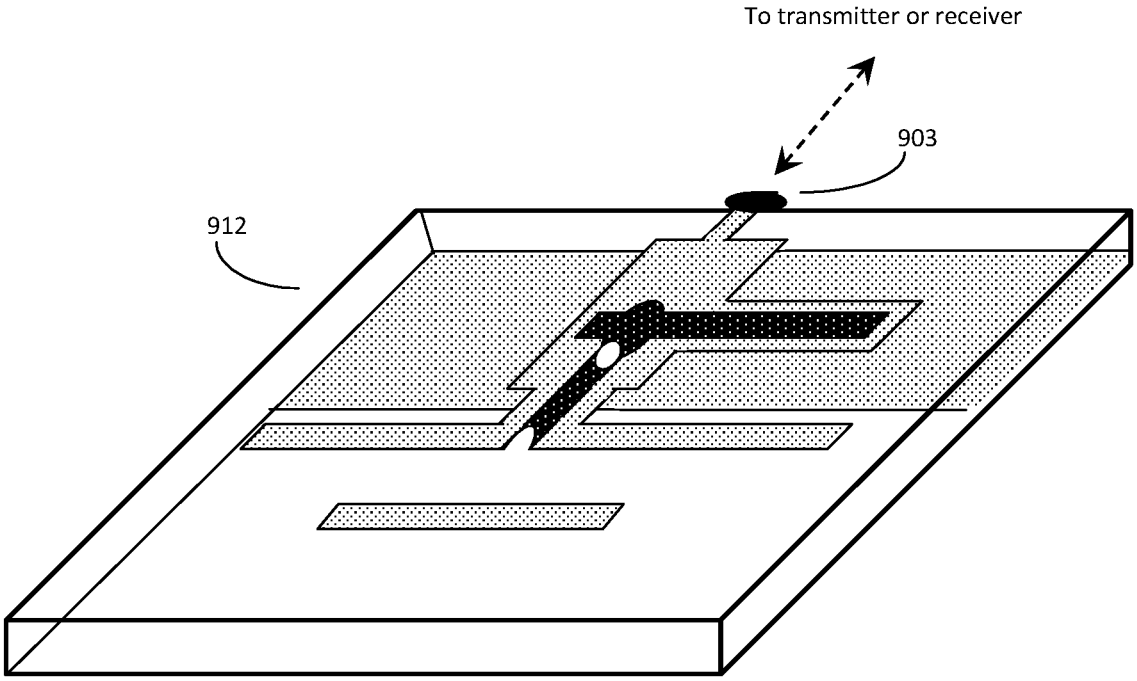
Figure 10B

Figure 11A
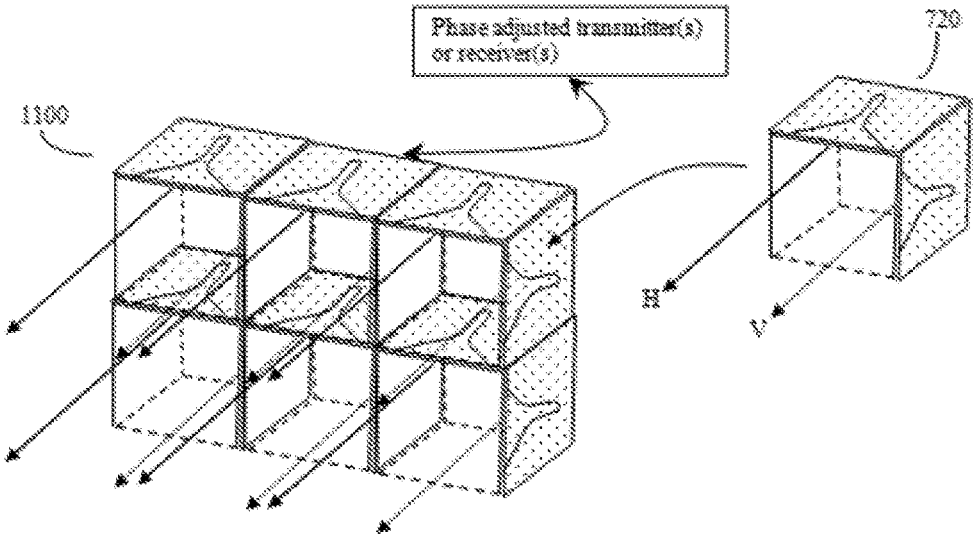
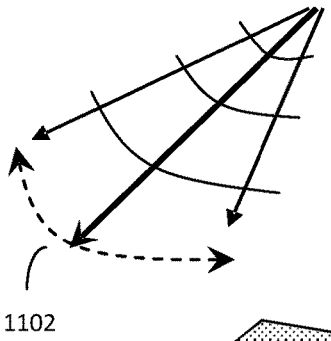
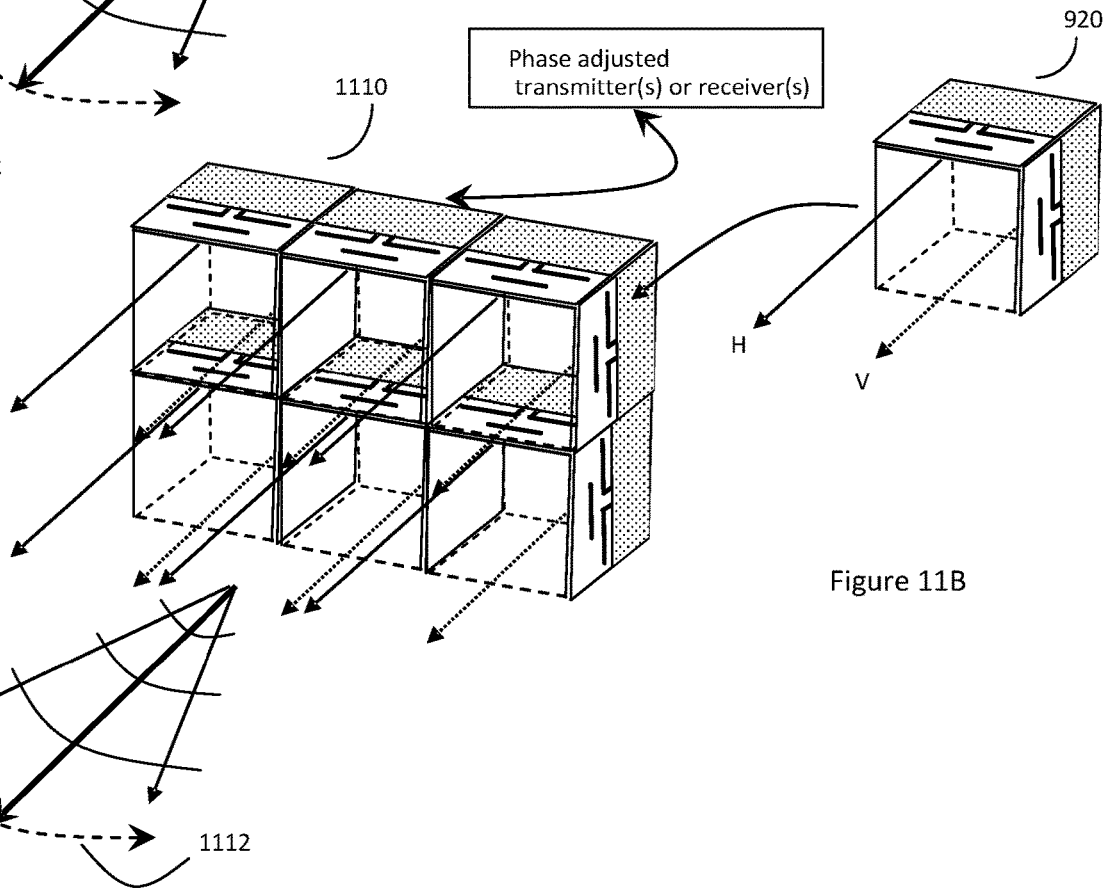
Figure 11B

Figure 12A
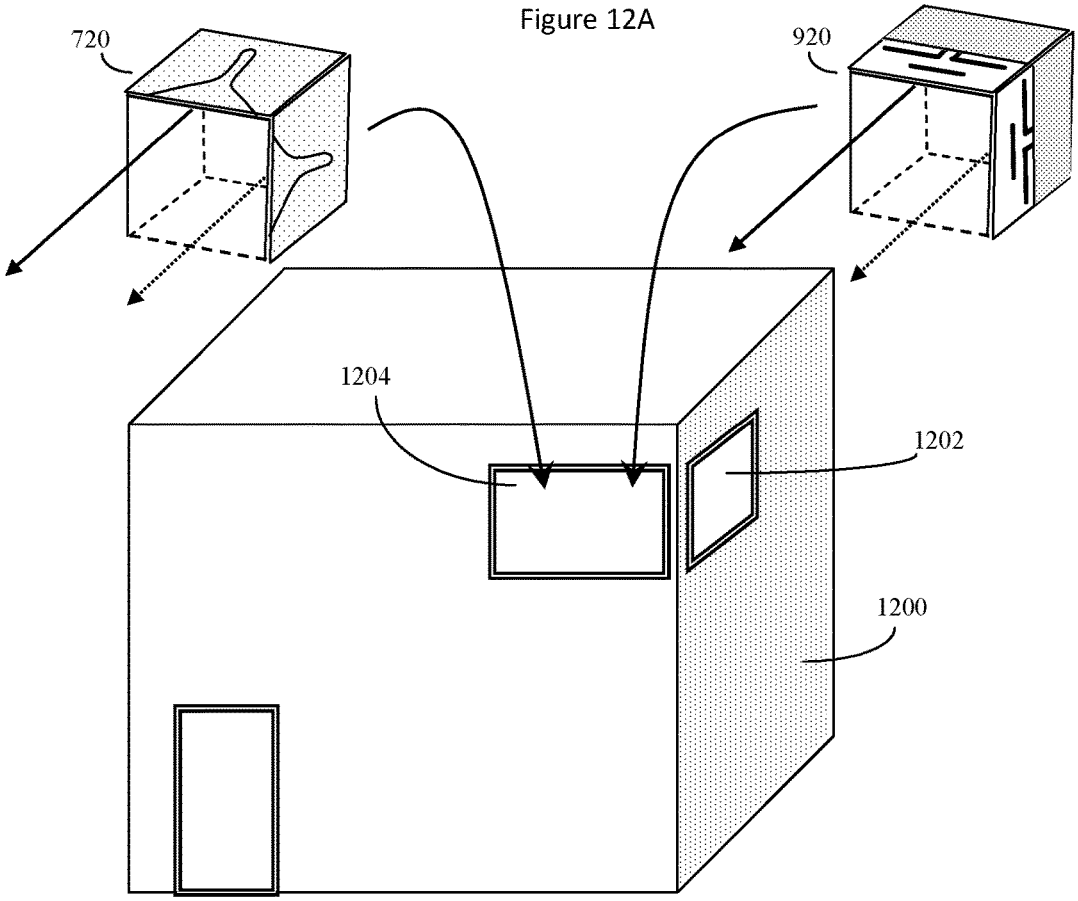
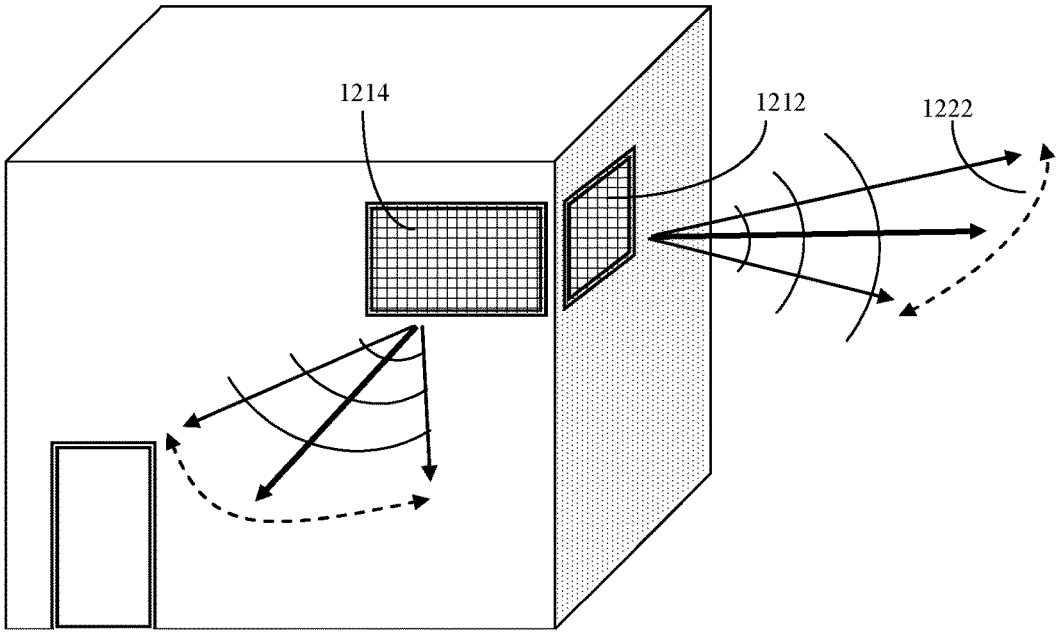
Figure 12B

Figure 13A
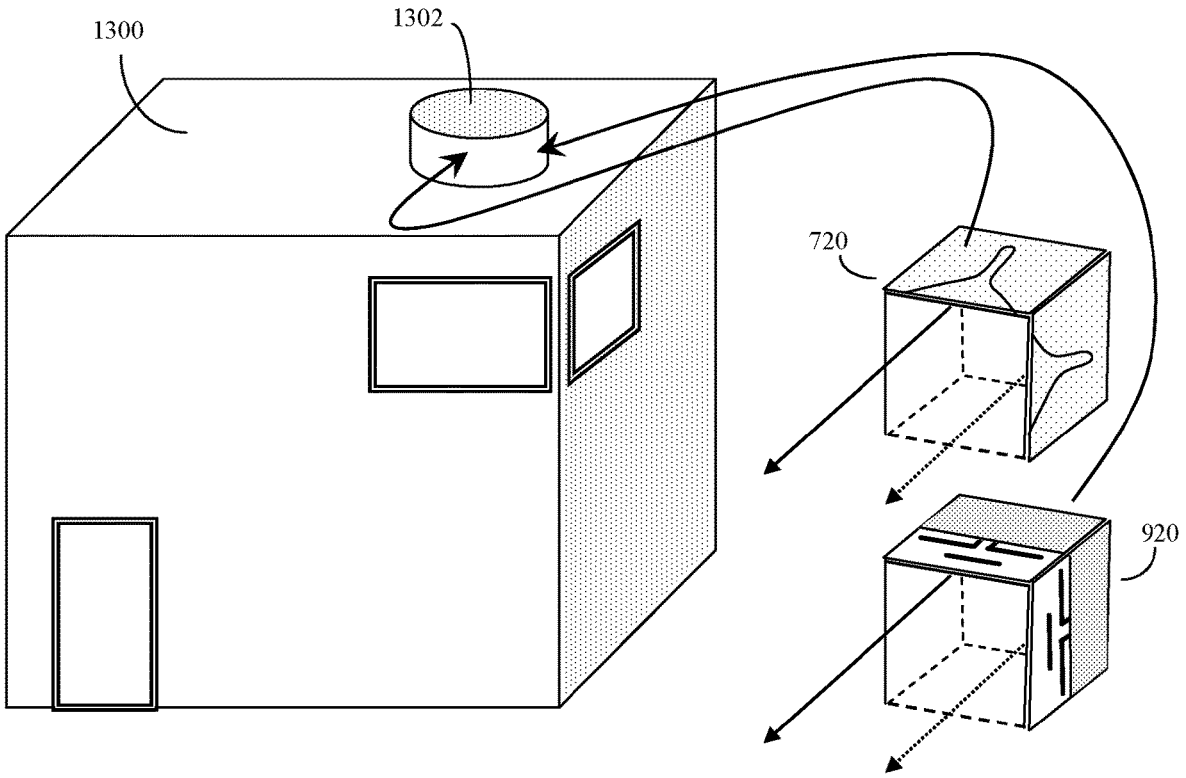
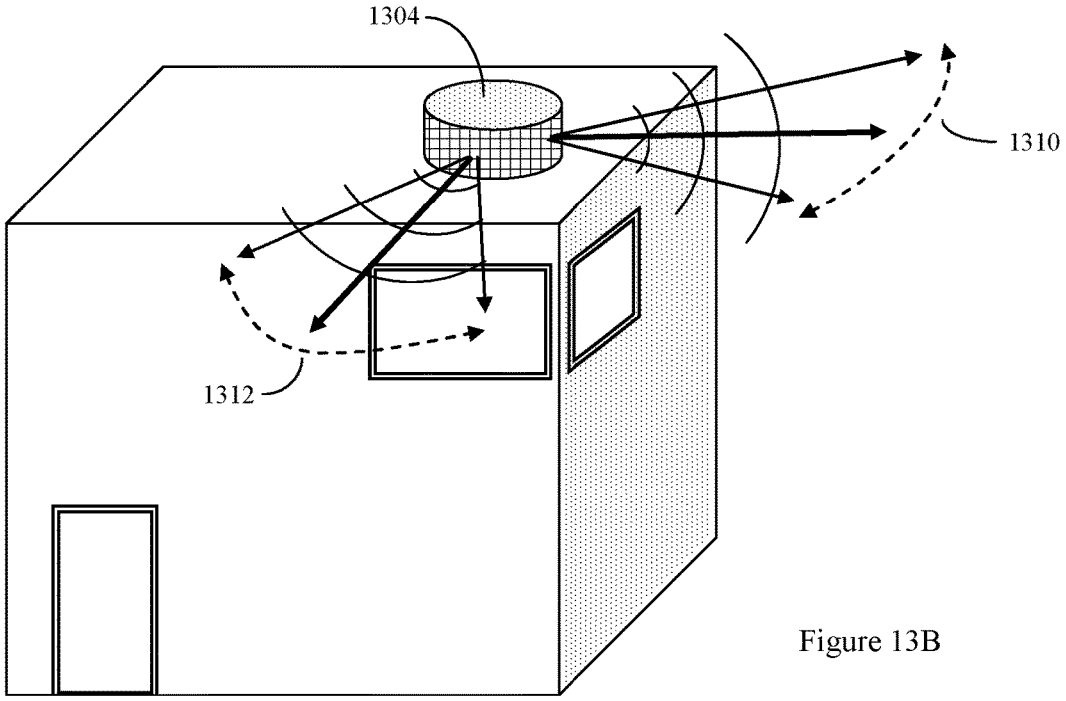
Figure 13B

INCONSPICUOUS MULTI-DIRECTIONAL ANTENNA SYSTEM CONFIGURED FOR MULTIPLE POLARIZATION MODES

CROSS-REFERENCE TO RELATED APPLICATIONS

The present application claims the benefit of priority under 35 U.S.C. § 119(e) of U.S. Provisional Application No. 62/189,541, entitled INCONSPICUOUS ANTENNA SYSTEM CONFIGURED FOR MULTIPLE POLARIZATION MODES ACROSS MULTIPLE DIRECTIONS, filed Jul. 7, 2015, which is incorporated herein by reference for all purposes.

FIELD

This disclosure relates to antennas used in wireless communications and, more particularly, to antennas configured to support multiple polarization modes.

BACKGROUND

With the advent of cellular communications and other modern wireless technology, various types of antennas, such as various cell site and cell tower based antennas, have become ubiquitous throughout the word. Existing cellular communication networks operate by dividing various local areas into cells, each of which is served by local cellular infrastructure (e.g., a "cell site"). Since each cell site is capable of handling only a limited number of local wireless connections, there are generally a relatively large number of cell sites deployed in cities and suburbs served by cellular communication systems.

Generally, cities and other communities require permits for cell sites to operate, and because many communities consider antennas to be aesthetically displeasing, residents may often oppose construction of new cell sites. In order to obtain the required permits, cell site owners and operators often need to disguise or camouflage their cell sites. In particular, the antennas associated with these cell sites need to be disguised or camouflaged. For example, cellular towers and their associated antennas have been configured to resemble other structures such as, for example, bell towers, brick building structures (e.g. chimneys, panels), cactus shapes, flab poles, pine tree shapes, palm tree shapes, sculpture, street lamps, and the like.

Motivated at least in part by a desire to decrease antenna costs, antenna designers have produced relatively sophisticated antenna designs using various types of relatively inexpensive printed and microstrip formats. Such antennas are generally formed via various layers of shaped conducting material mounted (often via printing, lithography, silk screening, or other process) on the surface of various non-conducting dielectric materials, usually with suitable ground planes that are also formed from a conducting material. These antennas can often perform well in the 300 MHz to 3 GHz+ range of frequencies.

Examples of such antennas include optically transparent antennas. See, e.g., U.S. Pat. No. 5,872,542 to Simons and Lee and U.S. Pat. No. 6,388,621 to Lynch, the entire contents of both of which are incorporated herein by reference. Printed Vivaldi antennas are exemplified by U.S. Pat. No. 6,518,931 Sievenpiper and by U.S. Pat. No. 6,525,696 to Powell and Marino, the entire contents of both of which are also incorporated herein by reference. Other types of known printed microstrip antennas include patch antennas, and the like.

SUMMARY

The antenna systems disclosed herein leverage the insight that the task of disguising antennas to be less conspicuous can be considerably reduced if the basic antenna design is itself made less conspicuous than conventional antenna designs. Aspects of the disclosed antenna designs are also premised, at least in part, on the insight that for optimal performance with more advanced wireless methods, such as OTFS, LTE, and the like, systems employing such inconspicuous antennas should ideally also be configured so as to support, generally for each directional antenna orientation, multiple polarization modes.

A first primary aspect of the disclosure is directed to a generally transparent antenna system, which for example may even be applied as a retrofit to existing structures such as building windows. A second primary aspect of the disclosure relates to a lattice like antenna system with a relatively large open structure allowing light and often also air to penetrate. This is possible because the lattice can be constructed with thin sides, and these thin sides can in turn comprise various types of thin antennas. These thin antennas may be of the "printed" type and in some cases may be transparent.

In relation to the first primary aspect of the disclosure there is disclosed a substantially transparent antenna system that in turn is comprised of a plurality of differently polarized antenna sets. Each of these polarized antenna sets will in turn comprise at least one first polarization mode antenna element that is coupled with at least one second polarization mode antenna element. Here, for each antenna set, the different polarized antenna elements are further configured so as to both point (e.g. have the same wireless beam directionality) in the same direction. An antenna system may be composed of many such antenna sets.

For example, in a given antenna set, a horizontal polarized antenna (antenna element) with a wireless beam directionality aligned according to a given direction may be paired with a vertical polarized antenna (antenna element) with a similar wireless beam directionally aligned according to the same direction.

Preferably at least some of these different antenna sets will also be configured to transmit and receive radio waves over a plurality of different directions. Put alternatively, in one embodiment, the antenna system may be characterized as a UHF (ultra high frequency) or SHF (super high frequency) version of a substantially transparent "compound eye", with each "eye" being an antenna set that can distinguish at least two different polarization modes. This allows a processing system associated with the antenna to determine the directionality of the various wireless waveforms received or transmitted by the antenna system.

For example, direct wireless waveforms impinging on the antenna might have come directly (e.g. in a straight line) from a given transmitter. By contrast, other wireless waveforms (replica waveforms) from a given transmitter that may have reflected off of various reflectors as they traveled from the transmitter to the receiver, and thus may impinge on the antenna at a different angle. Additionally, as the waveforms travel from the transmitter to the antenna, the polarization of the waveforms may also change depending on the characteristics of the surface reflecting the wireless waveforms. Thus wireless waveform directions and polarization states contain important information pertaining to various channel distortions that that the various wireless waveforms encountered in transit. Thus to make use of this information (for example to help deconvolute channel impaired signals), this sort of information must ideally be detected by the antenna system.

This scheme also has advantages for wireless transmissions as well, since it allows the antenna (in conjunction with appropriate processors) to select those polarization modes and wireless beam transmission directions that are best suited to overcome various reflectors and other channel impairments between the antenna and the remote receiver.

In one embodiment, at least some of the various antennas may be formed from a printing like process in which a substantially transparent conducting antenna material is deposited onto a relatively flat surface of a substantially flat and substantially transparent dielectric material. The resulting antennas can either be created as flexible sheets or rolls, or in a more rigid format. These substantially transparent antennas can then be mounted as, for example, windows in buildings in the like. Indeed, in some embodiments, adhesive may also be used to mount the antenna systems onto windows or other transparent surfaces as a retrofit.

With regard to the second primary aspect of the disclosure, there is disclosed an antenna system including antenna sets with lattice like structures, which may or may not have transparent or substantially transparent materials. For at least some of the antenna sets a first polarization mode antenna element is on a first surface and a second polarization mode antenna element is on a second surface. Over a number of such antenna sets, this can create a lattice like structure where, in each lattice region, the first surface forms a non-zero three dimensional angle with respect to the second surface. This angle can be a 90 degree angle or another angle.

The antennas can, for example, form a honeycomb like structure or other hollow solid (which may or may not be hexagonal, and may be square, triangular, or have some other repeating structure). The antenna can have a series of open regions surrounded by relatively thin walls, at least some of these thin walls being thin directional antennas with different polarization modes.

One advantage of this second primary aspect of the disclosure is that when viewed perpendicular to the hollow cores, the antenna system is relatively invisible, and also allows for the free passage of air. Thus as will be discussed, this antenna system lends itself to a variety of inconspicuous designs.

In one particular aspect the disclosure pertains to a dual polarized antenna system including at least a first antenna set and a second antenna set. The first antenna set is formed from a substantially optically transparent conducting material deposited on a surface of a first portion of substantially optically transparent dielectric material. The first antenna set includes a first polarization mode antenna element radiating in a first polarization in a first direction and a second polarization mode antenna element radiating in a second polarization in substantially the first direction. The second antenna set is also formed from the substantially optically transparent conducting material deposited on a surface of a second portion of substantially optically transparent dielectric material. The second antenna set includes a third polarization mode antenna element radiating in a third polarization in a second direction different from the first direction and a fourth polarization mode antenna element radiating in a fourth polarization in substantially the second direction.

In one implementation the first polarization is the same as the third polarization and the second polarization is the same as the fourth polarization. In this case the first polarization may be a horizontal polarization and the second polarization may be a vertical polarization.

The first polarization mode antenna element may comprise a multilayer patch antenna including a first layer of the optically transparent dielectric material. A ground plane of the patch antenna is formed from the optically transparent conducting material and deposited on a surface of the first layer of the optically transparent dielectric material. The patch antenna may further include a second layer of the optically transparent dielectric material and a first antenna patch formed from the optically transparent conducting material and deposited on a surface of the second layer of the optically transparent dielectric material. The patch antenna may further include a third layer of the optically transparent dielectric material, the third layer of the optically transparent dielectric material being interposed between the first layer of the optically transparent dielectric material and the second layer of the optically transparent dielectric material. In addition, the patch antenna may include a feed line formed from the optically transparent conducting material and deposited on a surface of the third layer of the optically transparent dielectric material.

The antenna system may further include a processor and a memory including program code which, when executed by the processor, causes the processor to actively adjust a phase of wireless signals transmitted or received by at least one of the first antenna set and the second antenna set so as to change at least one of the first direction and the second direction.

In another aspect the disclosure is directed to a dual polarized antenna system including a first antenna set and a second antenna set. The first antenna set includes a first polarization mode antenna element formed from a substantially optically transparent conducting material deposited on a surface of a first portion of optically transparent dielectric material. During operation, the first polarization mode antenna element radiates in a first polarization. The first antenna set further includes a second polarization mode antenna element radiating in a second polarization. The second polarization mode antenna element is also formed from the substantially optically transparent conducting material deposited on a surface of a second portion of optically transparent dielectric material. The surface of the first portion of optically transparent dielectric material forms a non-zero angle with respect to the surface of the second portion of optically transparent dielectric material. The second antenna set is formed from the substantially optically transparent conducting material wherein the substantially optically transparent conducting material is deposited on surfaces of portions of substantially optically transparent dielectric material.

The second antenna set may include a third polarization mode antenna element radiating in a third polarization. The third polarization mode antenna element may be formed from the substantially optically transparent conducting material wherein the substantially optically transparent conducting material is deposited on a surface of a third portion of optically transparent dielectric material. The second antenna set may further include a fourth polarization mode antenna element radiating in a fourth polarization. The fourth polarization mode antenna element may also be formed from the substantially optically transparent conducting material wherein the substantially optically transparent conducting material is deposited on a surface of a fourth portion of optically transparent dielectric material. The surface of the third portion of optically transparent dielectric material forms a non-zero angle with respect to the surface of the fourth portion of optically transparent dielectric material.

The dual polarized antenna system may further include a processor and a memory including program code which, when executed by the processor, causes the processor to actively adjust a phase of wireless signals transmitted or received by at least one of the first antenna set and the second antenna set so as to change at least one of the first direction and the second direction.

BRIEF DESCRIPTION OF THE DRAWINGS

The present disclosure is more fully appreciated in connection with the following Detailed Description taken in conjunction with the accompanying drawings. The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIGS. 5A and 5B illustrate a manner in which the substantially transparent directional antenna system can be mounted on the windows of a building.

FIGS. 8A and 8B show non-exploded diagrams of the Vivaldi antenna system previously shown in FIGS. 7A and 7B.

FIGS. 10A and 10B show a non-exploded diagram of the Quasi-Yagi antenna system previously shown in FIGS. 9A and 9B.

FIGS. 11A and 11B illustrate one manner in which a plurality of antenna sets can be combined to create a substantially open lattice type antenna.

FIGS. 12A and 12B depict a substantially open lattice type antenna inconspicuously mounted in different locations.

FIGS. 13A and 13B show substantially open lattice antennas mounted in an alternate configuration.

DETAILED DESCRIPTION

Figure 1:
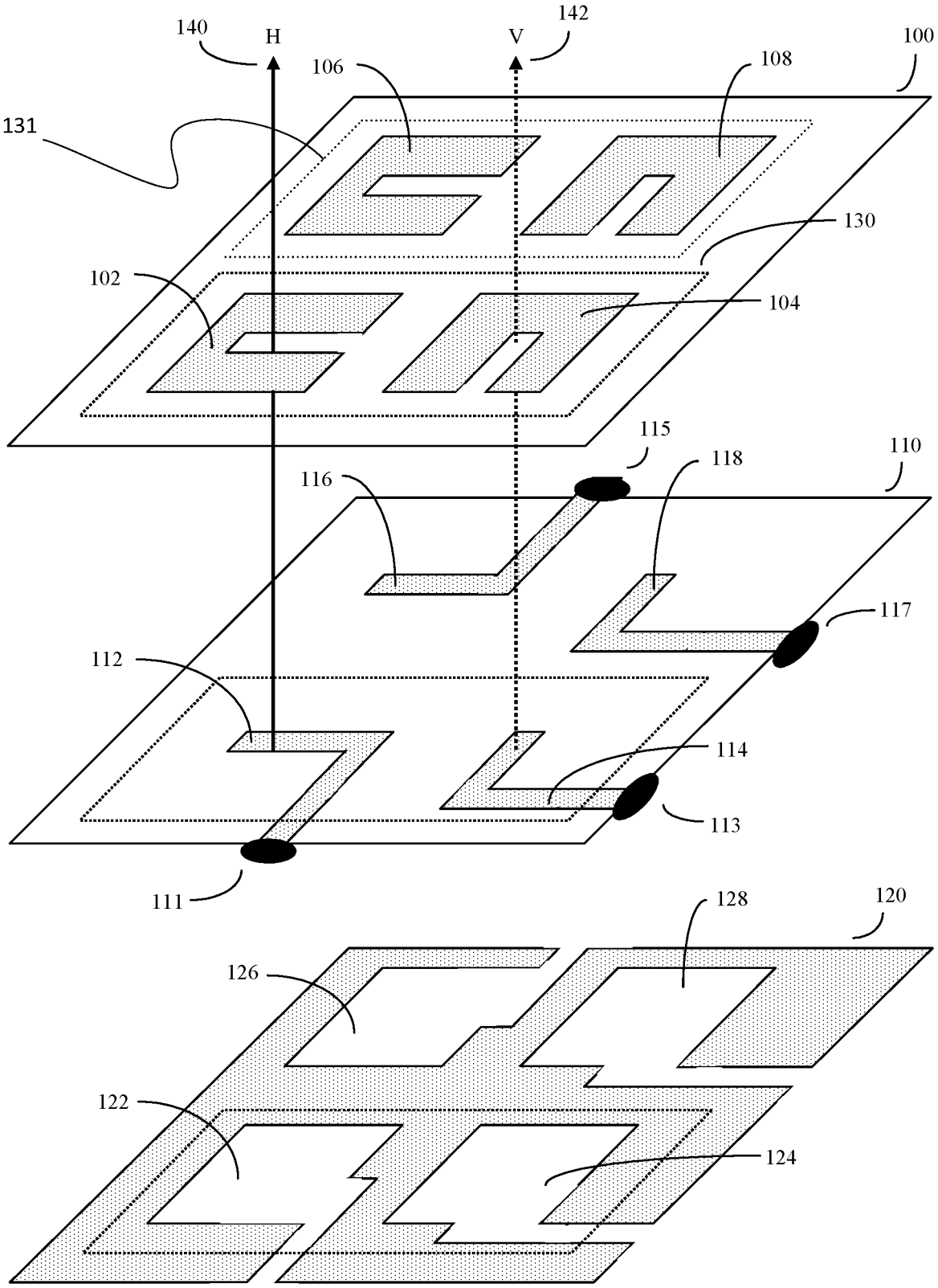
FIG. 1 shows an exploded diagram of the electrical conducting material portions of a substantially transparent directional antenna system that is composed of a plurality of differently polarized antenna sets.

Disclosed herein are implementations of inconspicuous antenna systems. In a first embodiment, the antenna system may be configured with substantially transparent conducting and dielectric materials, and optionally suitable metamaterials or photonic crystals. In a second embodiment, the antenna system may be configured as a largely (e.g. 80 to 90% or more) open lattice structure.

The antenna systems disclosed herein may be configured to function much like "compound eyes" that are capable of distinguishing wireless waveforms over a plurality of different polarization states and directions. The disclosed antenna systems may utilize combinations of a basic antenna structure in the form of a polarized antenna set. These polarized antenna elements (e.g. small antennas) may be assembled into antenna sets. Typically, most of the various antenna sets will also have different wireless directionality, so that one antenna set may be most sensitive to wireless waveforms along a first set of angles and directions, while a different antenna set may be most sensitive to wireless waveforms along a second set of angles and directions. Because the antenna systems are configured to be inconspicuous (e.g. either transparent, or made from a largely open lattice), the constituent antenna elements will frequently be based on various types of "printed antenna" like designs. These designs may involve stacking the various layers of the antenna elements on top of each another with minimal separation or otherwise or physically combining the layers.

Embodiments of the disclosed antenna system can be viewed as being comprised of a plurality of differently-directed antenna sets. As will be discussed, various methods may be used to adjust or tune the directionality of the various antenna sets. These methods can include using different antenna designs with different inherent directionality properties, actively adjusting the phases of the different antenna elements, passively adjusting the phases of the different elements (e.g. using microstrips of varying length), adjusting the direction of the substrate on which the antenna element is mounted, use of suitable metamaterials and/or photonic crystals, and the like. Other passive methods to adjust or tune the directionality of the various antenna sets include use of Rotman type lenses. With the Rotman type lens approach, either the various antenna elements, or alternatively the connections between the various antenna elements, may be configured according to the methods of U.S. Pat. No. 3,170,158 to Rotman, U.S. Pat. No. 8,736,503 to Zaghloul and Adler, and U.S. Publication No. 20080165068 to Caswell, the contents of all of which are incorporated herein by reference.

By contrast, in the active phase adjust approach, the antenna system will typically be configured to use its at least one wireless transceiver, at least one computer processor, and memory to actively adjust a phase of wireless signals transmitted or received by the plurality of polarized antenna elements so as to further control the directionality of said antenna system.

This results in an antenna system that, in conjunction with appropriate transceivers and processors, can better cope with complex real world environments. For example, consider the problem of cell phone communications in an urban environment. Typically wireless waveforms to and from the cell phone may, in addition to traveling directly from a given transmitter or receiver to the cell phone, will also often be reflected by various reflectors (often with different polarizations). As a consequence, by the time signals reach the antenna system the waveforms may be coming from different directions and may have altered polarizations. These differently polarized signals received from different directions may be combined to at least some extent using the channel state characterization methods contemplated by Orthogonal Time Frequency Space (OTFS) wireless communications systems. See, e.g., U.S. patent application Ser. No. 13/927,091; 13/927/086; 13/927,095; 13/927,089; 13/927,092; 13/927,087; 13/927,088; 13/927,091; 14/583,911, 15/152,464, and U.S. Pat. No. 9,071,285, the entire contents of each of which are incorporated herein by reference. However, such channel state characterization methods can be considerably enhanced by using antenna systems, such as those described herein, capable of providing directionality and polarization information useful in developing such channel state characterizations.

Of course, even high performance antenna systems may be useless if permission cannot be obtained to mount them in a suitable number of locations. The inconspicuous nature of the antenna systems disclosed herein is intended to assist in obtaining such permission. As will be discussed, the systems described herein may be installed as visually inconspicuous retrofits over building windows, street lights, air conditioning units, and the like.

Substantially Transparent Antenna System

As previously discussed, and as further shown in more detail in FIGS. 1-4, the disclosure is directed in one aspect to a substantially transparent antenna system. For purposes of the present discussion substantially transparent means that the antenna system will be configured to pass at least some light. In some embodiments, in which the antenna system is desired to also act to block strong sources of light, such as sunlight, the antenna may be configured to transmit as little as about 5% of incident light, and in this respect can act like category 4 (3-8% transmission) sun glasses. More typically, however, the antenna system will be designed to transmit substantially more light, similar to category 3 (8-17% transmission), category 2 (18-45% transmission), category 1 (46-79% transmission) or category 0 (80-100% transmission) sunglasses.

Because, as will be discussed, the various electrically conducting layers will often absorb at least 10% of the incident light per conducting layer, it will not usually be feasible to produce an antenna system that transmits 100% of the incident light, hence the "substantially" limitation.

The disclosed substantially transparent antenna systems will typically be configured with optically clear materials so as to allow images to pass through the antenna system with minimal distortion. However, in some applications, such as when opaque light transmitting antennas are desired, various cloudy or translucent materials that transmit light, but diffuse it to some extent, may also be used. These materials may be used when, for example, it is desired to obscure images or otherwise provide a degree of privacy. Accordingly, when used herein the term "transparent" is not intended to exclude embodiments using translucent materials.

The various antenna elements may be printed type antennas where, for example, layers of conducting antenna material and layers of dielectric material are stacked, laminated, or otherwise combined. Often the orientation of these antenna elements is such that the emitted or received wireless beams (radio waves) are often substantially perpendicular with the orientation of the various antenna elements. This design lends itself to relatively thin antenna structures where light may pass in a relatively unimpeded manner.

FIG. 1 shows an exploded diagram of the electrical conducting material portions of a substantially transparent directional antenna system composed of a plurality of differently polarized antenna sets. In the embodiment of FIG. 1 the polarized antenna sets are based on multilayered patch antennas, it being understood that other antenna types could be used in alternate embodiments. The system of FIG. 1 includes a first antenna set (130) and a second antenna set (132), both configured with the same directionality (if the antenna is kept flat, and neglecting phase adjustments between antenna sets). These antennas (130, 132) are formed from layers (100, 110, 120) of substantially transparent electrical conductors (shown) mounted on layers of substantially transparent dielectric materials (not shown in FIG. 1, see FIG. 2).

As shown in FIG. 1, various antenna patch elements (102, 104, 106, and 108) are disposed in an element layer (100) and the various microstrip feed lines (112, 114, 116, and 118) disposed in a feed line layer (110). A ground plane layer (120) is presented as an imperfect ground plane layer containing various holes (122, 124, 126, and 128) corresponding to the shapes of the antenna patch elements (102, 104, 106, 108) and the microstrip feed lines (112, 114, 116, 118).

In FIG. 1, the RF coupling joints between the various microstrip feed lines (112, 114, 116, and 118) and the system transmitters or receivers (not shown) are shown as (111, 113, 115, and 117).

Typically, the antenna systems disclosed can further comprise at least one wireless transceiver, and this transceiver in turn can further comprise and be controlled by at least one computer processor, and memory. In some embodiments, this at least one wireless transceiver, at least one computer processor, and memory can be used to adjust the various phases of the wireless signals transmitted or received by the various polarized antennas or antenna sets so as to further control directionality of said antenna system. Here nearly any type of transceiver may be used, including LTE transceivers, OTFS transceivers, and other type of transceivers.

Typically, the transparent conductive material has at least some optical absorbance, typically in the region of 5 to 90 percent. Thus, in cases in which some regions of an antenna are comprised of more transparent conductive material than other layers, the antenna may have a somewhat "patchy" appearance where, for example, two layers of conductive material blocked a higher percentage of light transmission than one layer of conductive material. Depending upon the application, this may or may not be objectionable.

Put alternatively, in some embodiments the conducting ground plane material (such as FIG. 2A 120) and the dielectric material(s) (such as FIGS. 2A 200, 210, and 220) may be substantially transparent but with visually apparent absorbance or optical depth (e.g. the various components may absorb about 5 to 90% of the light passing through them). Here, however, the pattern of the conducting ground plane material and the antenna element material and any antenna feed line material may be chosen so as to produce a transparent surface with a substantially uniform visual optical absorbance or optical depth over nearly all of the antenna's surface.

In this embodiment, the optical uniformity of the antenna (130, 132) has been enhanced by employing a design that overlays the various conducting materials in such a way so as to create a surface with a substantially uniform visual optical absorbance over the antenna's entire surface. This may be done by, for example, disposing the arrangement of the various antenna patch elements, microstrip feed lines, and holes in the ground plane layer so that when they all are aligned, there is exactly one layer of conductive material (here with all the same optical uniformity) at all regions of the antenna, thus creating a more visually uniform transparent or translucent antenna. In other embodiments, e.g., in the embodiments of FIGS. 2B and 2C, this has not been done.

In FIG. 1, the antennas (130, 132) each include a horizontally polarized antenna element, and a vertically polarized antenna element, are shown. The approximate direction of the horizontally polarized (140) and vertically polarized (142) wireless beams emitted by the two patch antennas in antenna set (130) are shown.

Figure 2A:
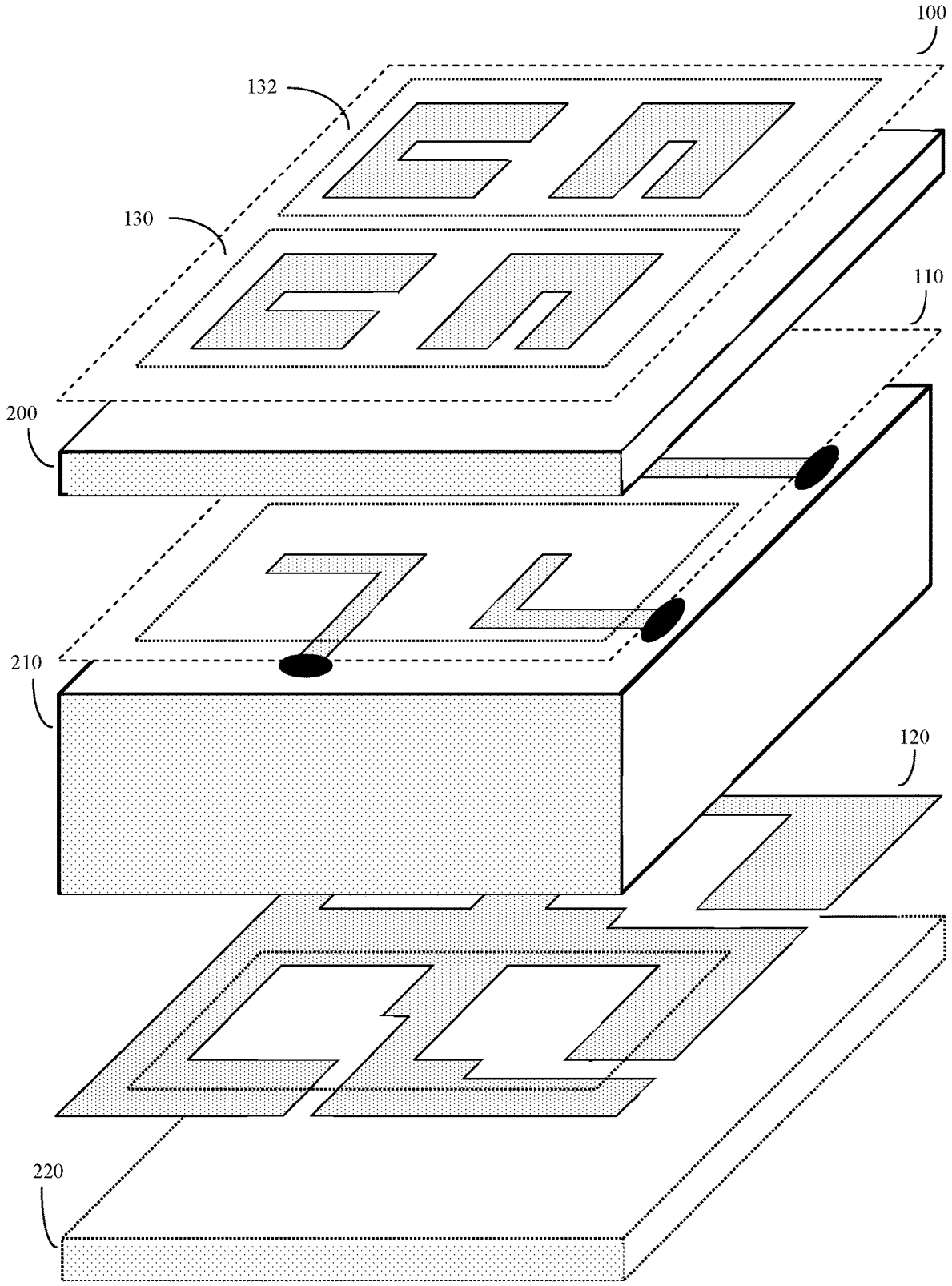
FIG. 2A shows an exploded diagram of a substantially transparent directional antenna system composed of a plurality of differently polarized antenna sets.

FIG. 2A is similar to FIG. 1, except that the layers of substantially transparent dielectric material (200, 210, 220) are also shown in FIG. 2A. As previously discussed, the antennas (130, 132) are formed from layers of substantially transparent electrical conductors (100, 110, 120) mounted on these layers of substantially transparent dielectric materials (200, 210, 220). Note that the width of the dielectric materials has been exaggerated so that the three dimensional structure of the antennas are easier to visualize. In FIG. 2A, the optical uniformity of the antenna has been further enhanced, possibly at the loss of some antenna efficiency, by employing a design that overlays the various materials so as to create a surface with a substantially uniform visual optical absorbance over the antenna's entire surface.

Figure 2B:
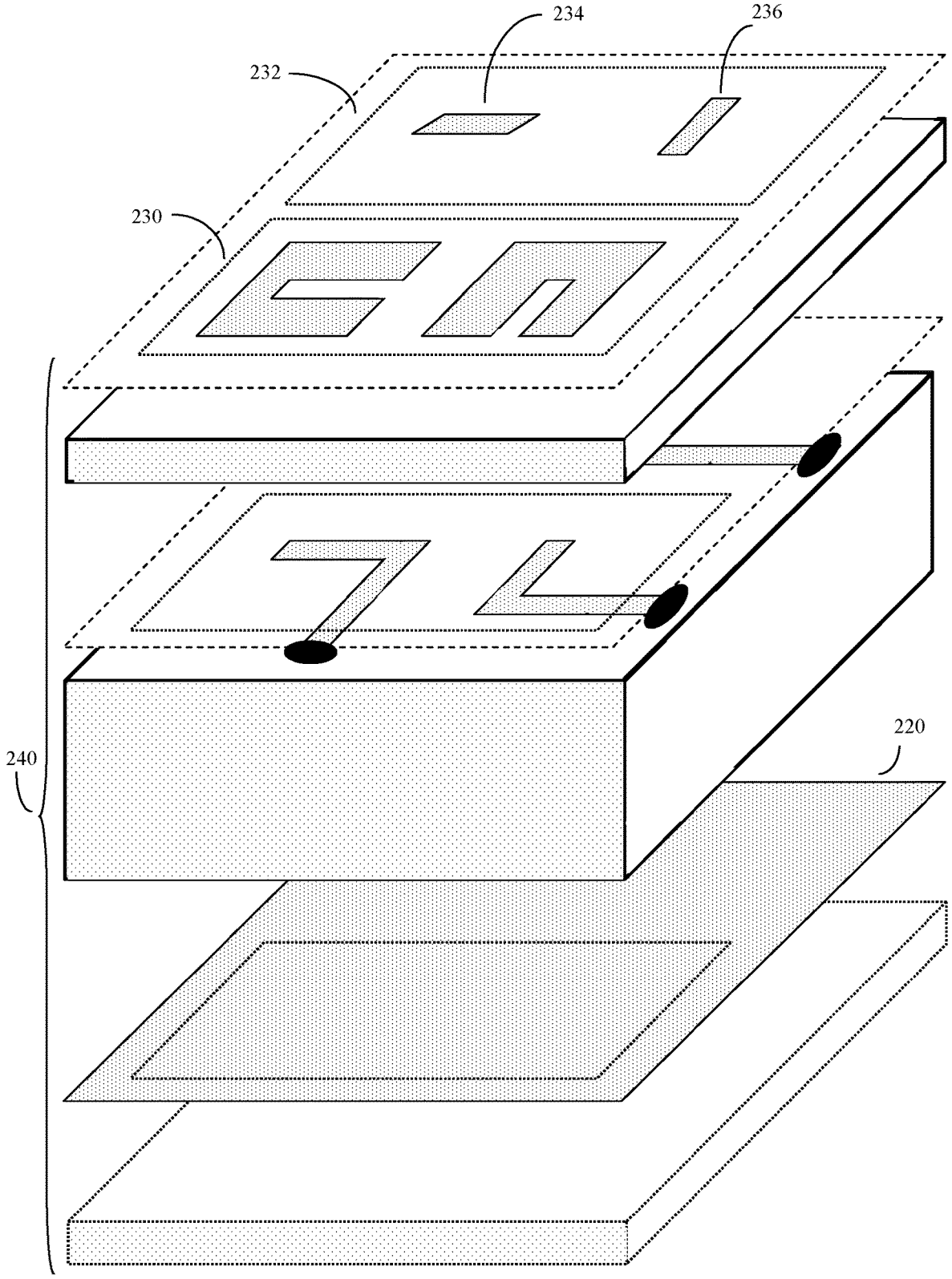
FIG. 2B shows an exploded diagram of a different embodiment of a substantially transparent directional antenna system composed of a plurality of differently polarized antenna sets.

FIG. 2B shows an exploded diagram of a different embodiment of a substantially transparent directional antenna system that is also composed of a plurality of differently polarized antenna sets. Here one set (230) is generally based on the multilayered patch antenna design previously shown in FIGS. 1 and 2A, while the other antenna set (232) is based on a different type of antenna design, such as a modified Quasi-Yagi antenna. Here the horizontal and vertical directors for this Quasi-Yagi antenna are shown as (234) and (236), while the drivers for the Quasi-Yagi antenna were previously shown in FIG. 1 as (116) and (118). In this embodiment, the ground plane is shown as (220), and it does not have any holes. The sum total of all of these layers is shown (in exploded form) as (240).

Note that ground planes, either perfect ground planes (such as shown in FIG. 2B (220), or imperfect ground planes (such as shown in FIGS. 1 (120) and 2 (120)) are typically used for the various antenna elements (for usually for all polarization modes) disclosed herein. That is the various antenna elements typically further comprise a ground plane (e.g. 120, 220) formed from conducting ground plane material that has been deposited onto a surface of a dielectric material (e.g. 210, or 220) that is substantially opposite to the other conducting antenna material(s) (e.g. the conducting materials shown in 100 and 110)

More specifically, in some embodiments, the conducting antenna material such as the material in layer FIG. 2A (110) may deposited on a first surface of a substantially flat dielectric material such as FIG. 2A (210), and the conducting ground plane material such as FIG. 2A (120) may be deposited on an opposite surface of the same dielectric material (210). In FIG. 2B, the two antenna sets (230) and (232) each generally have different types of antenna elements. For example, antenna set (230) is a horizontally and vertically polarized set of modified patch antennas. Antenna set (232) is a horizontally and vertically polarized set of Quasi-Yagi antennas.

Here for simplicity, we will generally refer to the different polarized versions of a given antenna design as still representing the same type of antenna element. Thus a horizontally polarized patch antenna, and a vertically polarized patch antenna, if other design elements are the same, will generally be discussed in this disclosure as if they have equivalent angles of directionality and equivalent design.

The two types of antenna element designs (in this example, patch vs Quasi-Yagi antenna design) have correspondingly different patterns of antenna beam directionalities. That is the range of angles over which electromagnetic energy is received or transmitted can differ depending upon the design of the antenna element. These different ranges of angles (different patterns of antenna element directionality) are shown in more detail in FIG. 2C (250) and (252).

Additionally, although in FIG. 2B, these antennas elements and sets are also formed from layers of substantially transparent electrical conductors mounted on substantially transparent dielectric materials, note that some regions of the antenna in FIG. 2B, the various antenna elements will have more layers of conducting material than other regions. This is because here, the goal has been to make fewer compromises in antenna efficiency, and instead use a ground plane (220) that does not have any holes in it. Thus the various conductive materials in the configuration shown in FIG. 2B do not necessarily create a surface with an entirely uniform visual optical absorbance over the antennas entire surface. Instead the antenna, while still substantially transparent, may have at least some mild degree of visible patches and/or patterns.

Figure 2C:
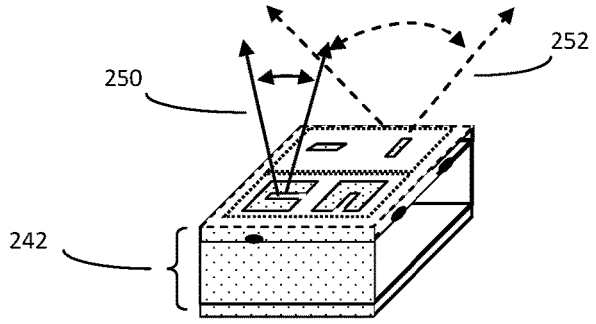
FIG. 2C shows a 25% scale image of FIG. 2D.
Figure 2D:
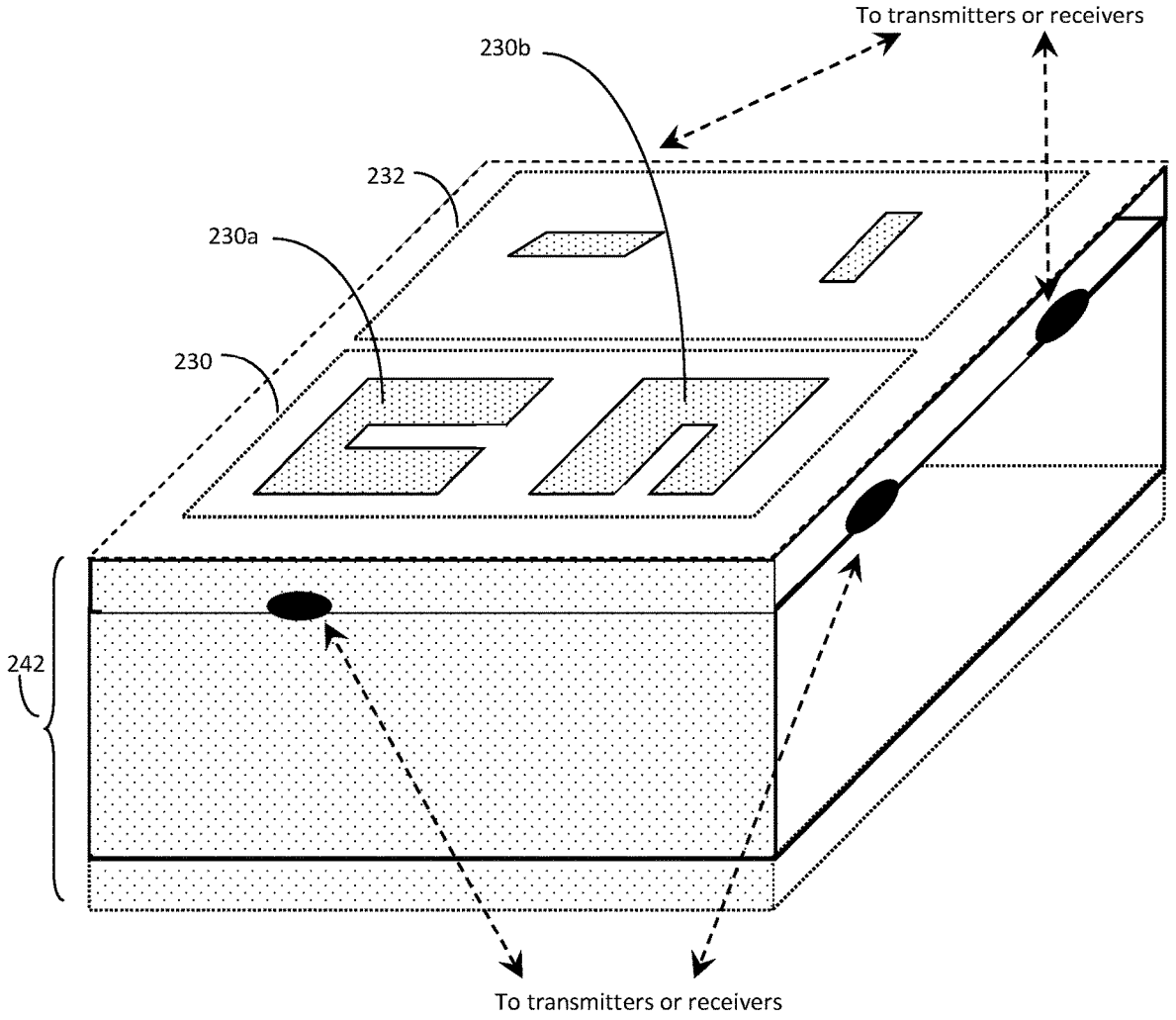
FIG. 2D shows a non-exploded diagram of the substantially transparent directional antenna system previously shown in exploded form in FIG. 2B.

FIG. 2C (242) shows a 25% scale image of the non-exploded diagram (242) of FIG. 2D, described in more detail below. FIG. 2C illustrates differences in the areas of coverage between a patch antenna element (250) from the patch type antenna set (FIG. 2D, 230), versus the areas (252) for a Quasi-Yagi antenna element from the Quasi-Yagi antenna set (FIG. 2D, 232). That is, the area of coverage of the patch antenna type antenna set may be different from the area of coverage of the Quasi-Yagi antenna set.

Note that if it is desired to have the area of coverage of the various antenna sets to differ, there are various ways to obtain this objective. One way, illustrated in FIGS. 2B, 2C, and 2D is to use different antenna sets with different types of antenna elements. Alternatively, the various antenna sets, even if they all have the same type of antenna element design, need not be mounted on a flat surface, but instead can be mounted on a curved or angled surface so that the different surface angles in turn cause the different antenna sets and antenna elements to have different directionality. For example, a patch antenna oriented in "direction 1" will have a different directionality from the same type of patch antenna oriented in "direction 2". This later method is shown in more detail in FIGS. 5 and 6.

FIG. 2D shows a non-exploded diagram (242) of the substantially transparent directional antenna system previously shown in exploded form (240) in FIG. 2B and at 25% scale in FIG. 2C. Here to better show the overall structure, the various dielectric layers (comparable to FIG. 2A 200, 210, 220) are made non-transparent. Note that in this embodiment, as previously shown in FIG. 2C, one of the differently polarized antenna sets is configured to transmit and receive radio waves over a plurality of different directions that differ with respect to the other differently polarized antenna sets. That is, the area of coverage of the patch antenna type antenna set (230) may be different from the area of coverage of the Quasi-Yagi antenna set (232).

Note that although only two antenna sets are presented in certain of the disclosed embodiments (e.g. FIG. 2D sets 230 and 232, each set having two antenna elements with different polarizations), in other embodiments the antenna system will typically have a much larger number of antenna sets and antenna elements. For example, consider the case where each antenna element is a type of patch antenna, such as a rectangular (square) patch antenna, with dimensions of roughly 2" square, separated from other patch antennas by a distance of about 3-4 inches, so that each antenna set has a dimensions of roughly 7.5 feet by 7.5 feet (for the sake of round numbers and simple calculations). If this antenna system was configured to cover a window, of dimensions of roughly 7.5 feet by 7.5 feet, then the antenna system just for this window might have 15×15 or roughly 225 antenna sets, and if each antenna set has 2 differently polarized antenna elements, then there would be 450 antenna elements in this 7.5 foot by 7.5 foot antenna system.

Consider further that it is desired to give the system a "compound eye" type directionality by further partitioning the various antenna sets into groups of 9 (e.g. a 3×3 antenna set arrangement), thus producing roughly a 5×5 zone (25 zones) arrangement within the 7.5×7.5 foot antenna. Within each group of 9 antenna sets that comprises a zone, the lengths of the various microstrips connecting the various antenna elements in that zone to suitable junctions can be adjusted so as to "tilt" the directionality of that particular zone away from the perpendicular to the antenna surface. The net effect is to produce an antenna system that functions as a crude 5×5 element compound eye, where each "eye" (zone of 3×3 antenna sets) in the compound eye is looking at a somewhat different direction, and each "eye" is also able to discern at least two different polarization states.

Figure 2E:
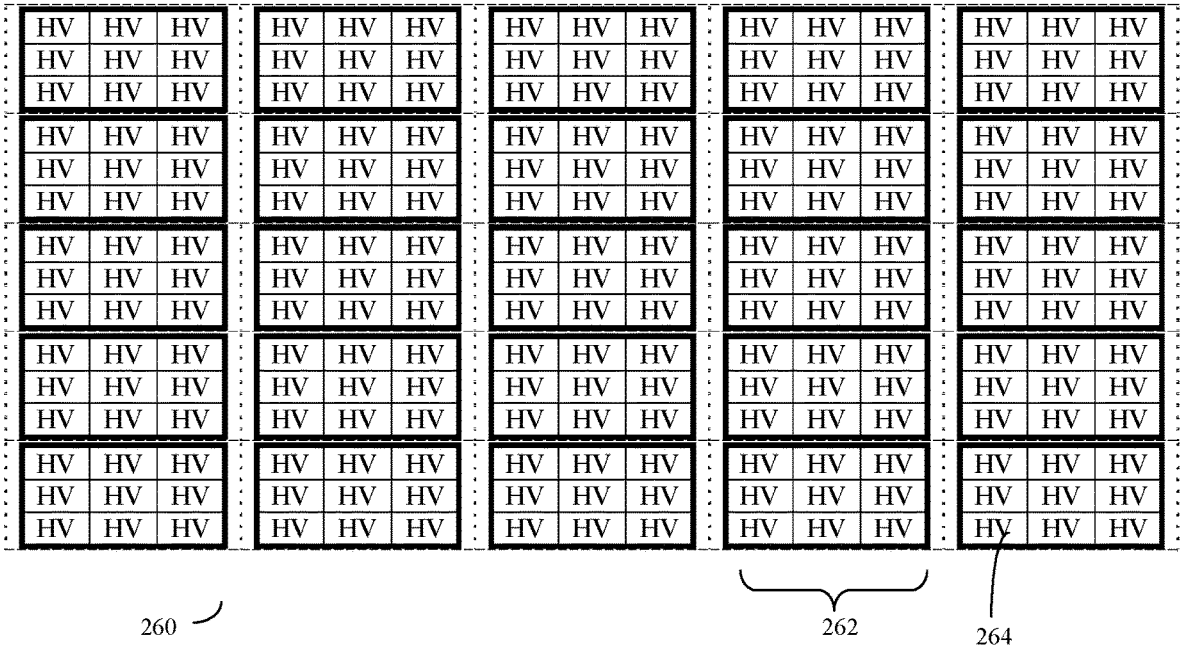
FIG. 2E shows an example of a larger substantially transparent directional antenna with a plurality of antenna sets arranged into 3×3 zones.

FIG. 2E shows an example of a larger (260) substantially transparent directional antenna with 225 antenna sets (264) (the different polarities of each antenna element in an antenna set are shown by a "H" or "V"). Each of the various antenna sets are further arranged into 3×3 zones, so that the antenna forms 25 zones (262). Each zone is configured with a different directionality (by phase adjustment), and each zone can distinguish at least two polarization states.

Figure 2F:
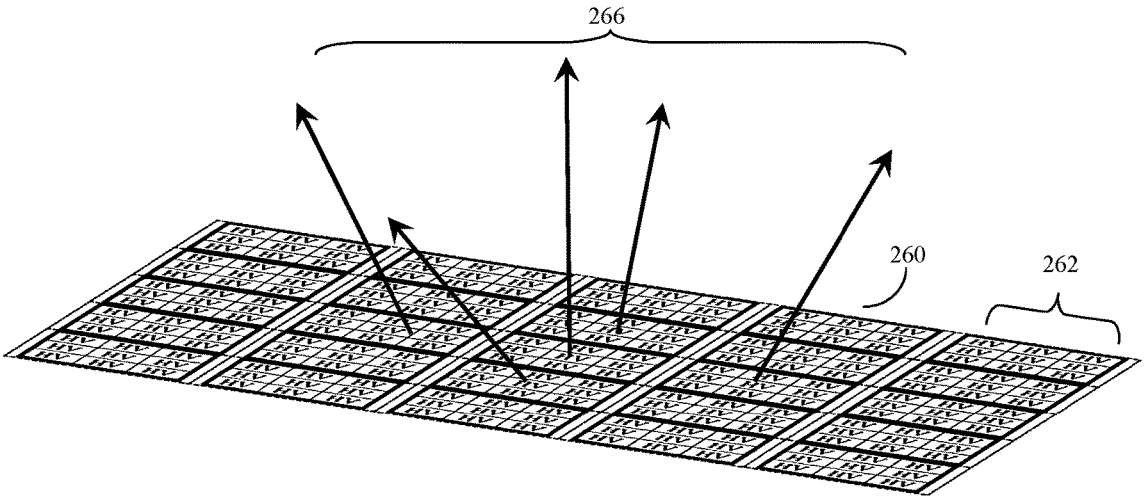
FIG. 2F shows a perspective view of the 25 zone antenna previously shown in FIG. 2E.

FIG. 2F shows a perspective view of the 25 antenna zones (262) previously shown in FIG. 2E. Here the different wireless directionality of some of the various antenna zones is further shown by the arrows (266).

Figure 3A:
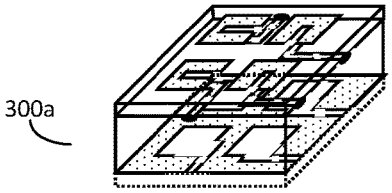
FIG. 3A shows a 25% scale image of the non-exploded diagram of the substantially transparent directional antenna system shown in FIG. 3C.
Figure 3B:
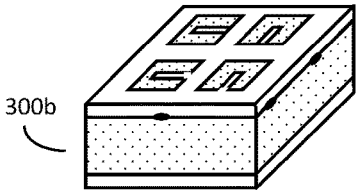
FIG. 3B shows a 25% scale image of the non-exploded diagram of the substantially transparent directional antenna system shown in FIG. 3C.
Figure 3C:
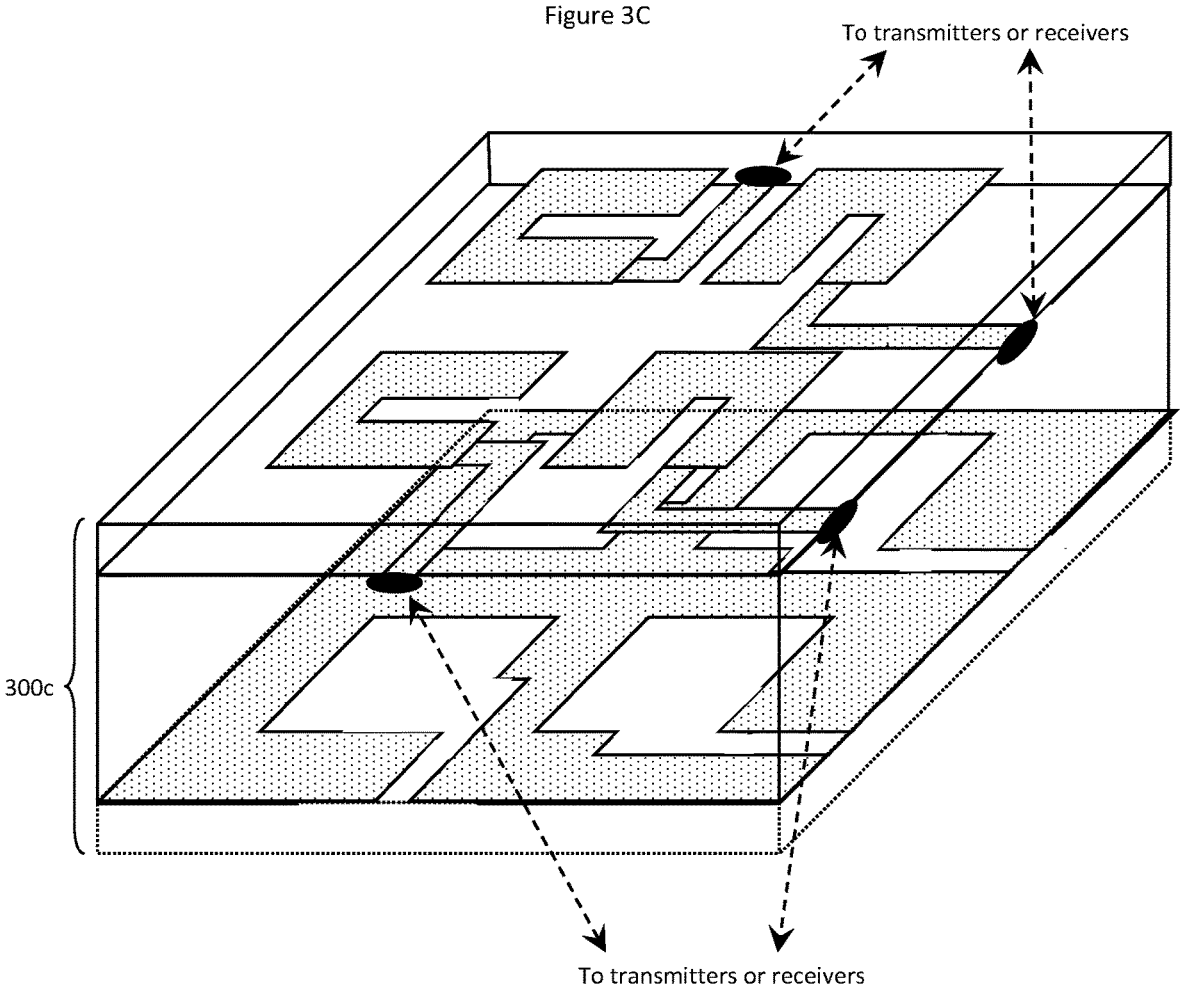
FIG. 3C shows a non-exploded diagram of the substantially transparent directional antenna system previously shown in FIG. 2A.

FIG. 3C shows a non-exploded diagram of the substantially transparent directional antenna system previously shown in FIG. 2A. Here the various dielectric layers (corresponding to FIG. 2A 200, 210, and 220) are shown as completely transparent so that the 3D internal structure of the antenna can be better appreciated. This stacked arrangement is shown as (300*c*).

FIG. 3A shows a 25% scale image of the non-exploded diagram of the substantially transparent directional antenna system shown in FIG. 3C. Here the dielectric portion of the antenna is rendered as completely transparent. This stacked arrangement is shown as (300*a*).

FIG. 3B shows a 25% scale image of the non-exploded diagram of the substantially transparent directional antenna system shown in FIG. 3C. Here the dialectic portion of the antenna is rendered as opaque to better see the overall shape of the antenna. This stacked arrangement is shown as (300*b*).

As per FIGS. 1 (111, 113, 117, and 115), the regions where RF energy can be applied to the antenna system from various wireless transmitters, or retrieved from the antenna system from various wireless receivers, are shown as the black ovals.

Thus in some embodiments, the antenna system may comprise a plurality of differently polarized antenna sets (exemplified by (230) and (232)). Within an antenna set, the various antenna elements will typically have the same type of design, but will be configured otherwise to be polarized in different polarization modes.

Here, each polarized antenna set (e.g. 230 or 232) will typically comprise at least one first polarization mode antenna element (FIG. 2D 230*a*) that is coupled with at least one second polarization mode antenna element (FIG. 2D, 230*b*).

Here an "antenna element" (e.g. 230*a*, or 230*b*) is itself a functional antenna. However since we are speaking of an antenna system typically comprised of a plurality of "antenna sets" (e.g. 230, 232) often arranged with different directionality (e.g. 250, 252), and where each "antenna set" may have two or more "antenna elements" (e.g. 230*a*, 230*b*) with different polarizations but the same directionality, here the term "antenna element" is useful to help distinguish between the various portions of the system.

As FIG. 2C shows, the various antenna elements may not always be omnidirectional. Rather, at least some of the various antenna elements will often be configured to transmit and/or receive wireless RF waveforms according to at least some amount of directionality. This directionality can be employed by using different types of antennas that are mounted on surfaces that point in the same direction, or by the same type of antennas that are mounted on surfaces that point in different directions, or various combinations of antenna types (configurations) and antenna surface directions.

In terms of antenna types, note that even when mounted on surfaces pointing in the same directions, different antenna designs can achieve differing patterns of wireless beam directionality.

For example, some types of antenna elements, such as half-wave dipole antennas, have a relatively broad range of beam directions and can achieve relatively small amounts of directivity, such as around 1.5 (2 dB) or greater. Other types of antenna elements, such as patch (or microstrip type antennas), can achieve narrower more focused beams with directivity around 3 to 6 (5-8 dB) or greater.

Thus various types of antenna designs may be used in accordance with the disclosure. These antenna designs are preferably antenna designs that can be produced by printing layers of material onto dielectric surfaces, including but not limited to designs such as dipole antennas, patch antennas, Quasi-Yagi antennas, spiral antennas, folded beverage antennas, tapered slot antennas (such as Vivaldi antennas), inverted-F antennas, c-slot antennas, monopole antennas, and reflectarray antennas.

In other embodiments alternative antenna designs may be utilized. For example, horn antenna designs such as, for example, Vivaldi designs, can achieve still more tightly focused beams with a higher amount of directionality (e.g., between 10 to 100 (10-20 dB)).

Examining this directionality on a per antenna set basis, typically within a set, the different antenna elements (each element often configured to detect a different polarization mode from the other antenna elements in that set) may be configured with the same directionality. That is, the at least one first polarization mode antenna element (e.g. 230*a*) will typically be configured with a substantially similar directionality (e.g. 250) and wireless directional orientation as the at least one other second polarization mode antenna element (e.g. 230*b*). Thus for each antenna set (e.g. 230), the antenna elements (e.g. 230*a*, 230*b*) in that particular set, although having different polarization modes (e.g. horizontal and vertical), will each have substantially similar wireless coverage of a substantially similar (i.e. overlapping) range of directions (e.g. 250).

Again considering the "compound eye" embodiment, the generally transparent antenna may be considered to be comprised of various antenna sets functioning as compound "eyes". Often, each antenna set of "eye" is sensitive to a somewhat different range of directions (i.e., is characterized by a different directionality or directional orientation) and polarization modes. One advantage of this configuration is that it enables the antenna system to better acquire data showing how the antenna surroundings may distort. In addition it enables the antenna system to transmit wireless signals having a better chance of being detected by outside receivers. This is useful for many types of wireless schemes, and is particularly useful for OTFS wireless schemes.

For embodiments utilizing substantially transparent materials, the conducting antenna material will typically be a layer of a substantially transparent conducting material. Suitable conducting materials include compositions of Indium Tin Oxide. Other materials that may be used include graphene, carbon nanotubes, aluminum gallium or indium doped zinc oxide, transparent conducting polymers, or other substantially transparent conducting materials.

As can also be seen in FIGS. 1-4, at least some and often all of the various polarized antenna sets (e.g. antenna sets containing differently polarized antenna elements), the various polarized antenna elements (e.g. at least one first polarization mode antenna element and said at least one second polarization mode antenna element) will typically be formed from a conducting antenna material that has been deposited onto a surface of a dielectric material. This surface may, but need not, be a planar surface. In some embodiments, the surface may be curved, or different regions may be faceted at different angles, so that an antenna set positioned at one region of the surface need not point in the same direction as a different antenna set positioned at a different region of the surface. In the transparent embodiment, however, typically this dielectric material will be a substantially transparent conducting material.

In some embodiments, this dielectric material may comprise comprises one or more thin flexible materials, that, for example, may be manufactured in rolls, and then applied to another surface of interest, such as a window, using a suitable adhesive or other mounting means. Here for example, one of the layers of antenna dielectric material, or other antenna support, can be mounted on an adhesive backing. This adhesive backing in turn can be configured to enable this layer of antenna dielectric material, or other antenna support, to in turn adhere to a support surface (for example a window as shown in FIGS. 5A and 5B), thereby adhering the antenna system to the support surface.

Alternatively the dielectric material may comprise one or more thicker non-flexible materials. For example, the antenna may be directly embedded into a more rigid a glass or transparent acrylic or poly (methyl methacrylate) or other substantially rigid transparent dielectric material, preferably in a sheet like format. This can then be used to produce self-supporting transparent or translucent antennas that in turn can be incorporated into window frames, mirrors, street lights, and the like. Examples of these embodiments are shown in more detail in FIGS. 5 and 6.

Thus, either by depositing different types of antenna sets with different directionality onto the antenna support surface (typically a dielectric material), and/or by depositing antenna sets onto various regions of a surface where each surface region orients the antenna sets in a different direction, the antenna system can be configured so that at least some of the various differently polarized antenna sets are able to both transmit and receive radio waves over a plurality of different directions differing with respect to other the different directions of other differently polarized antenna sets. Put simply, the different antenna sets can point in different directions (see FIGS. 5A and 5B and FIG. 6). Additionally, as previously described in FIG. 2C, the different antenna sets can also have different beam widths, so that the different beams end up covering different directions.

As desired, these various different directions can span up to 360 degrees on a horizontal plane, and up to 360 degrees on a vertical plane (e.g. the antenna can cover any and all angles). Here each individual polarized directional antenna element can span a variety of different directions up to 90 degrees on a horizontal plane, and up to 90 degrees on a vertical plane.

In some embodiments, the performance of the antenna systems disclosed herein may be further enhanced using various types of metamaterials (including photonic crystals). These are typically engineered materials, often containing various microscopic repeating patterns (typically repeating on a scale that is often somewhat smaller than the wavelength transmitted by the antenna), and have a refractive index that is typically less than zero. Here for example, transparent or translucent metamaterials may be used, for example to help further shape the directionality of the beams emitted or received by the various types of antenna sets, as well as to help provide improved electromagnetic isolation between nearby antenna sets. Such metamaterials are reviewed in Sihvola, "Metamaterials in electromagnetics", Metamaterials I (2007) pages 2-11. Electromagnetically-transparent metamaterials are described by, for example, Liu et. al., in U.S. application Ser. No. 13/522,954, the entire contents of which are incorporated herein by reference. Antennas containing metamaterials are described in, for example, U.S. Pat. Nos. 6,958,729, 6,958,729 and 7,855,696 to Gummalla et. al., the entire contents of both of which are incorporated herein by reference.

Thus in some embodiments, for at least some of the various polarized antenna sets, or for at least some of the first polarization mode antenna elements and the other (e.g. second) polarization mode antenna elements, the various antenna elements or antenna sets can be further separated by metamaterials, or have metamaterial overlays. For example, some of the various dielectric layers may be metamaterial type dielectric layers (e.g. optical dielectric materials). These metamaterial types and configurations can be selected to, for example, confer at least partial wireless isolation between metamaterial separated polarized antenna sets, and/or alter the polarization or directionality of the various antenna elements in the polarized antenna sets. Alternatively or additionally, these metamaterial types and configurations can be selected to confer at least partial wireless isolation between metamaterial separated first polarization mode antenna elements and other (e.g. second) polarization mode antenna elements. When different antenna sets may be used for transmitting and receiving, such metamaterials may also be useful to help reduce cross talk between transmitting antenna sets and receiving antenna sets. For transparent embodiments, it will often be useful to choose optically transparent metamaterials for these purposes.

In some embodiments, the antenna system described herein may be configured a distributed antenna system (DAS). Such DAS antenna systems often function as wireless repeaters, and are useful for bringing wireless coverage to wireless isolated areas, such as regions within a building, that may be wirelessly isolated from the outside world due to metal building components (e.g. support beams, wiring), and the like.

More specifically, in some embodiments, the antenna systems described herein may be further configured as a DAS distributed antenna system. This DAS distributed antenna system will typically be configured to transfer wireless signals inside and outside of a structure (such as a building). Here at least some of the various polarized antenna sets as may be disposed as outside antenna sets (e.g. on the outside of buildings, in windows, or other parts of the building where wireless signals from the outside world are not obstructed). These outside antenna sets can be used to receive and transmit wireless signals outside of the structure. Additionally, at least some of the polarized antennas sets may be disposed (usually in building areas with limited wireless coverage) as inside antenna sets to receive and transmit wireless signals inside of the structure. These outside and inside antenna sets may be connected (e.g. may transfer wireless signals back and forth) by various methods. These signal transfer methods can include passive direct electrical connections (e.g. wire connections), thus producing a passive DAS system. Alternatively the connection may involve various active steps, such active signal amplification and/or frequency shifting connections, thus producing an active DAS system.

Figure 4:
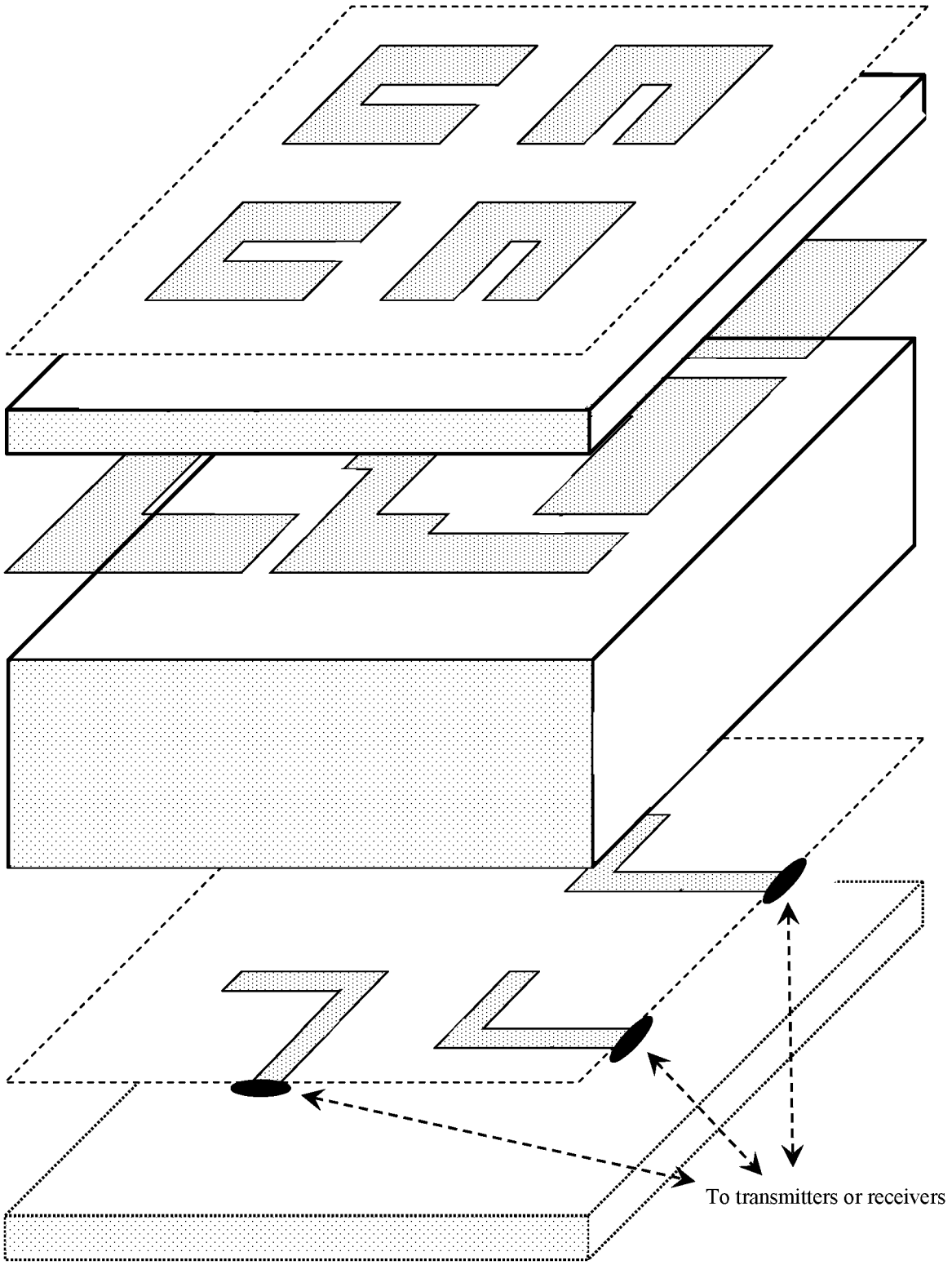
FIG. 4 shows an exploded diagram of an alternate type of substantially transparent directional antenna system composed of a plurality of differently polarized antenna sets formed from multilayered aperture coupled patch antennas.

FIG. 4 shows an exploded diagram of an alternate type of substantially transparent directional antenna system composed of a plurality of differently polarized antenna sets, here based on multilayered aperture coupled patch antennas. These antennas are formed from layers of substantially transparent electrical conductors mounted on substantially transparent dielectric materials. Here as well, the optical uniformity of the antenna is further enhanced by employing a design that overlay the various materials so as to create a surface with a substantially uniform visual optical absorbance over substantially the antenna's entire surface. In this design, the efficiency of the aperture cut into the ground plane has been somewhat reduced in order to create a more visually uniform transparent antenna.

FIGS. 5A and 5B show how the substantially transparent directional antenna systems previously shown in FIGS. 1 through 4 can, for example be mounted on the windows (502, 504) of a building (500). Because these antenna systems are configured to present a visually substantially uniform and transparent appearance, neither the utility of the windows, nor the overall appearance of the building, is significantly impacted. This makes it easier to obtain permission to mount the antenna system in a wide variety of different locations.

Here for example, various antenna sets, even where the various antenna elements are of the same design, such as previously shown in FIG. 3B (300*b*) can be mounted on a window such as (502) or (504). The various antenna elements may then be configured for different directionality though a transceiver system (not shown) that uses phase techniques for directionality purposes. Alternatively the various antenna elements may be configured and phase adjusted using microstrip segments of different effective lengths. This allows the signals sent or received from some antenna elements connected by longer microstrip segments to be delayed relative to the signals sent or received from other antenna elements connected by shorter microstrip segments. This results in phase differences between the different antenna elements that can be used to configure the directionality of these particular antenna elements. This later "variable length microstrip" approach has the advantage that it is entirely passive and also low cost. Alternatively, the antenna sets may be mounted on more than one window, such as the different sides of a corner window (502), (504) and obtain different directional orientations in this manner.

As yet another alternative, different types of antenna sets, where each antenna set design has different beam widths across different directions, such as the design previously shown in FIG. 2C (242) may be used.

FIG. 5B shows a close up of the building windows once the antenna system has been applied to the window. A representation of some of the various antenna sets is shown as (512) and (514). As can be seen these differently polarized antenna sets transmit and receive radio waves over a plurality of different directions (513, 515) that differ with respect to other differently polarized antenna sets in this antenna system.

The antenna systems may be either mounted as part of newly manufactured transparent windows, or alternatively applied to standard transparent windows as a retrofit. For example, the antennas may be bounded onto transparent windows using transparent adhesives, or by other types of fastening or mounting systems. In some embodiments, antenna manufacturers may find it desirable to pre-mount transparent adhesive on to the antennas (e.g. double sided adhesive), possibly protected by a peel-off liner. The liner may then be peeled off, and the antenna then applied to a transparent window as a retro fit.

Figure 6:
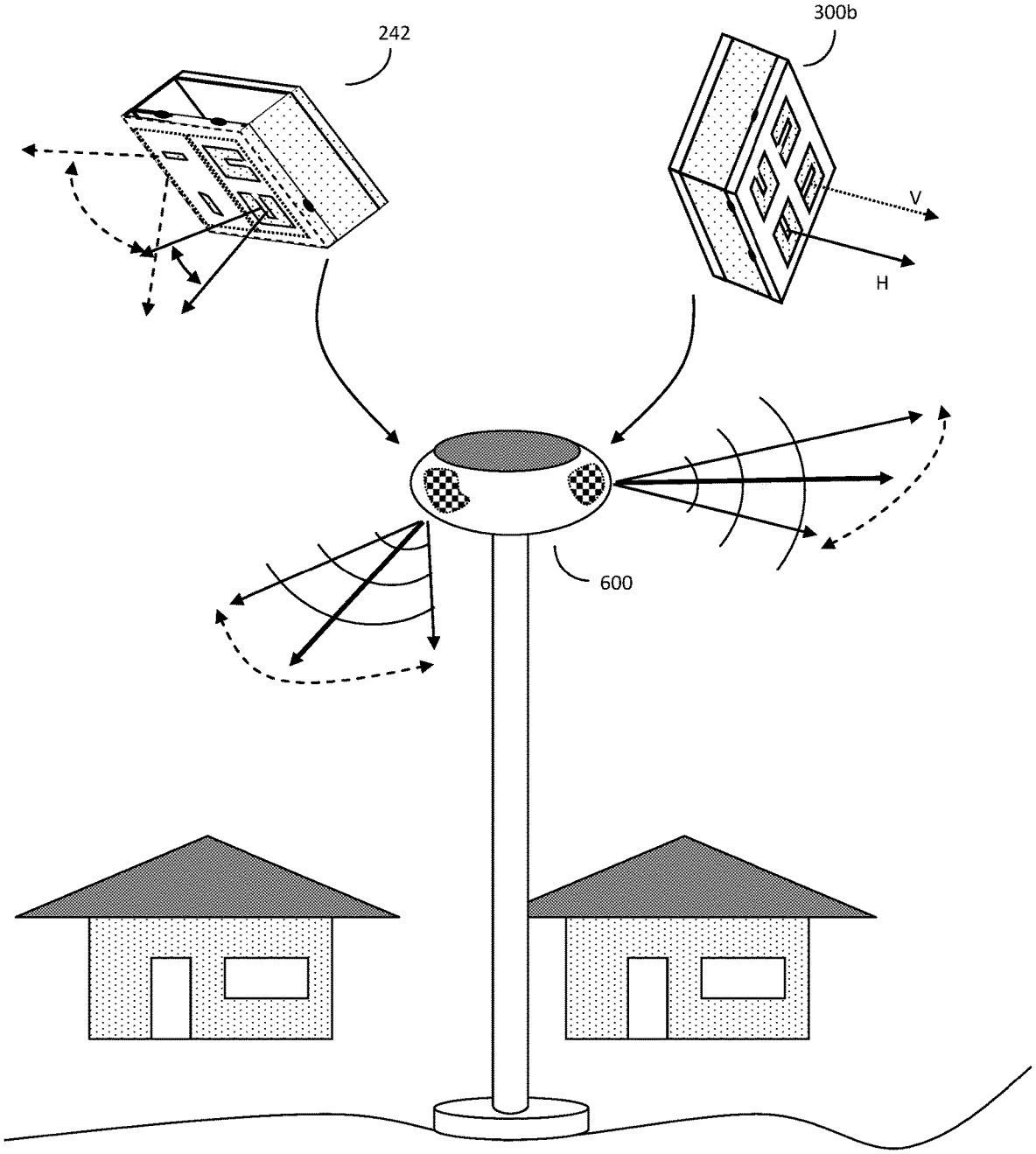
FIG. 6 shows how the substantially transparent directional antenna system can be mounted in other locations, such as street light fixtures.

FIG. 6 shows how the substantially transparent directional antenna systems previously shown in FIGS. 2, 3, and 4 can be mounted in other locations, such as street light fixtures (600). Here again, because the antenna is configured to present a visually substantially uniform and transparent appearance, neither the utility of the street light fixture, nor its overall appearance, need be significantly impacted. This again makes it easier to obtain permission to mount the antenna system in a wide variety of different locations.

Lattice-Type Antenna System

As previously discussed, a second primary embodiment is directed to an inconspicuous antenna system with a lattice like structure (see FIGS. 11A and 11B), which may or may not have transparent or substantially transparent materials. In many implementations of this embodiment the antenna system appears substantially open, and is thus inconspicuous, when viewed perpendicular to a surface of the antenna sets. That is, in such embodiments the antenna system is configured to allow light and/or air pass through the various antenna sets and elements. In this sense it may be viewed as being more of a substantially open lattice type arrangement.

Although the various antenna elements utilized in this second primary embodiment may be printed-type antennas where, for example, layers of conducting antenna material and layers of dielectric material are stacked, laminated, or otherwise combined, here the orientation of the antenna elements may often be substantially parallel or collinear with the emitted or received wireless beams (radio waves), rather than substantially perpendicular with the emitted or received wireless beams. There antenna structures are often comparatively thicker than the first embodiment, and there may not be a requirement that light is able to traverse the antenna material. However as will be seen, in this second main embodiment, the antenna system and sets have a lattice like structure that often contains a substantial amount of open area where light and air may pass freely. In this respect, the second primary embodiment is distinct from other types of Vivaldi antenna arrays, such as the phased arrays of Lambert et. al., U.S. Pat. No. 8,736,505, due to this substantial amount of open area.

Figures 7A, 7B:
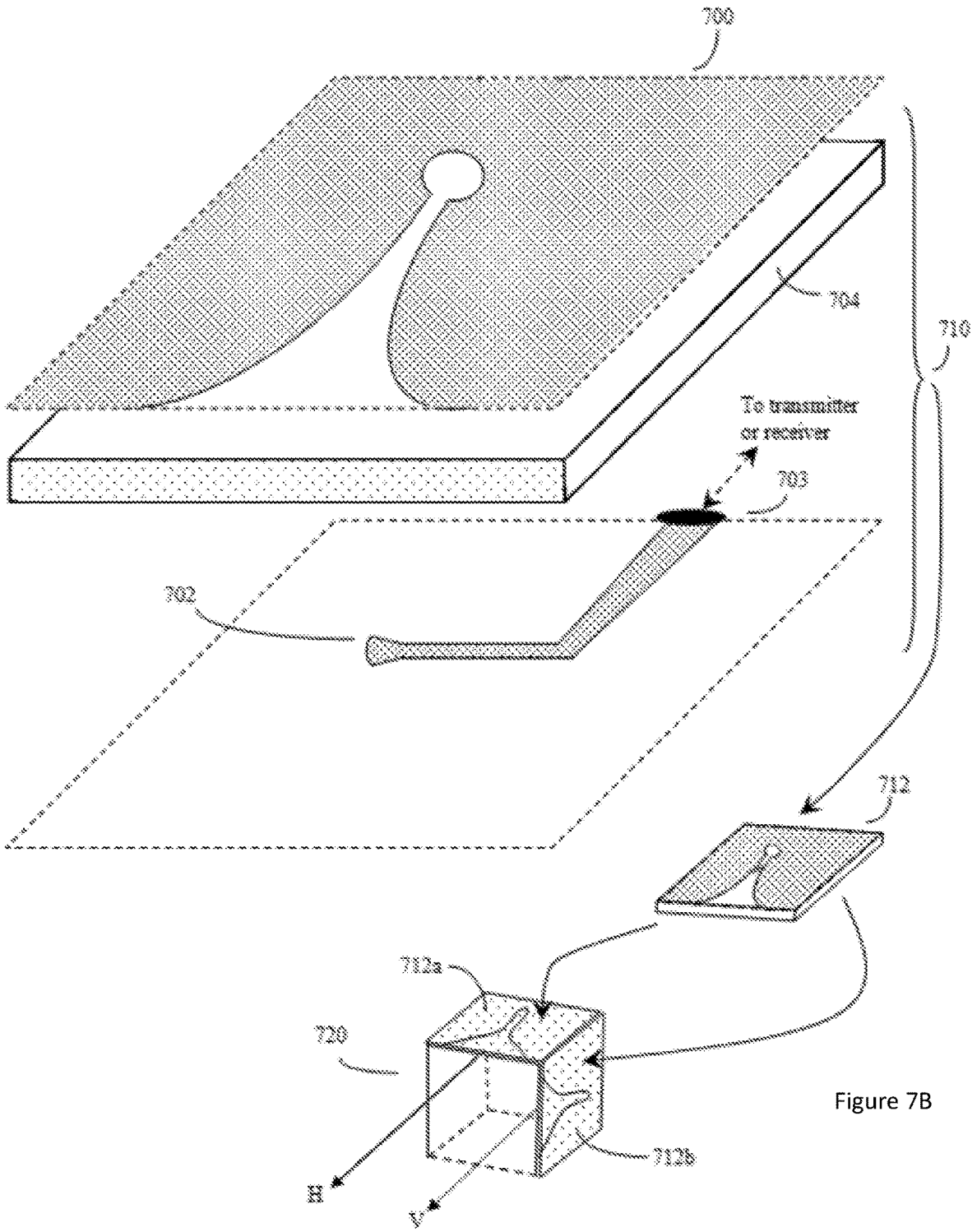
FIGS. 7A and 7B show an example of how two or more flat antennas can be configured to form polarized antenna sets by arranging at least one polarized antenna on a first surface and another polarized antenna onto a second surface at a non-zero angle relative to the first polarized antenna.

FIGS. 7A and 7B, for example, show how various layers of conducting material (700), (702) and dielectric material (704) may be configured and printed, stacked, laminated or otherwise combined (710, 710) to produce a Vivaldi type antenna element or similar type tapered slot antenna element. More specifically, FIG. 7B shows an example of how two or more flat (and often printed) antennas (712*a*, 712*b*), such as tapered slot antennas and Vivaldi antennas, can be configured to form polarized antenna sets. Here, for example, one polarized antenna element (712*a*) on a first surface, and another polarized antenna element on a second surface (712*b*) can be joined at a non-zero angle (here a 90° angle is shown) relative to the first polarized antenna (712*a*), thus creating a polarized, non-uniform direction, antenna set (720). Here this antenna set has a cube like appearance, where antennas (712*a*) and (712*b*) form two sides of the cube. Regions where RF energy can be applied to this antenna from various wireless transmitters, or retrieved from the antenna system from various wireless receivers, are shown as the black oval.

The top and bottom of the cube may be open (no material present), thus allowing light and air to traverse the cube. The other sides of the cube may be formed from other antenna elements or by non-antenna material. Note that although a cube is shown, many other antenna set shapes are also possible.

Note that in this example, the two antennas (712*a*) and (712*b*) will generally span roughly the same plurality of directions (e.g. emit wireless beams with approximately the same directionality), but will typically have different polarizations (e.g. one horizontally polarized, one vertically polarized, for example). Of course there is no requirement that the various antennas in an antenna set be the same type of antenna design.

Thus a plurality of such cubes can be combined to create an open lattice, such as is often used for many structural, artistic, and architectural purposes. The first antenna is shown in both an exploded diagram form and in a smaller non-exploded diagram form.

FIGS. 8 and 8A show a non-exploded diagram of the Vivaldi antenna system (712) previously shown at 25% scale in FIGS. 7A and 7B.

Thus, the second primary embodiment may be also viewed as comprising an antenna system that in turn comprises a plurality of differently polarized antenna sets. Each polarized antenna set comprises at least one first polarization mode antenna element, which is typically coupled with at least one second polarization mode antenna element. Within an antenna set, the at least one first polarization mode antenna element will generally be configured with a substantially similar directionality and wireless directional orientation as the at least one second polarization mode antenna element. Thus an antenna set, over its various (at least two) polarization modes, will typically provide substantially similar wireless coverage of a substantially overlapping range of directions.

As before, in the antenna system at least some of the plurality of differently polarized antenna sets will typically be further configured to transmit and receive radio waves (e.g. wireless waveforms) over a plurality of different directions that differ with respect to other differently polarized antenna sets. In other words, not all antenna sets will be "looking" at exactly the same thing. Different antenna sets may be pointed in different directions, or may have different angles of coverage (e.g. wide angle, narrow angle), and so on.

Typically, for at least some of the polarized antenna sets, the various antenna elements (e.g. the at least one first polarization mode antenna element and the at least one second polarization mode antenna element) may be formed from a conducting antenna material (or materials) (such as 700, 702) that have been deposited onto at least one surface of at least one dielectric material (such as (704)).

Figure 9A:
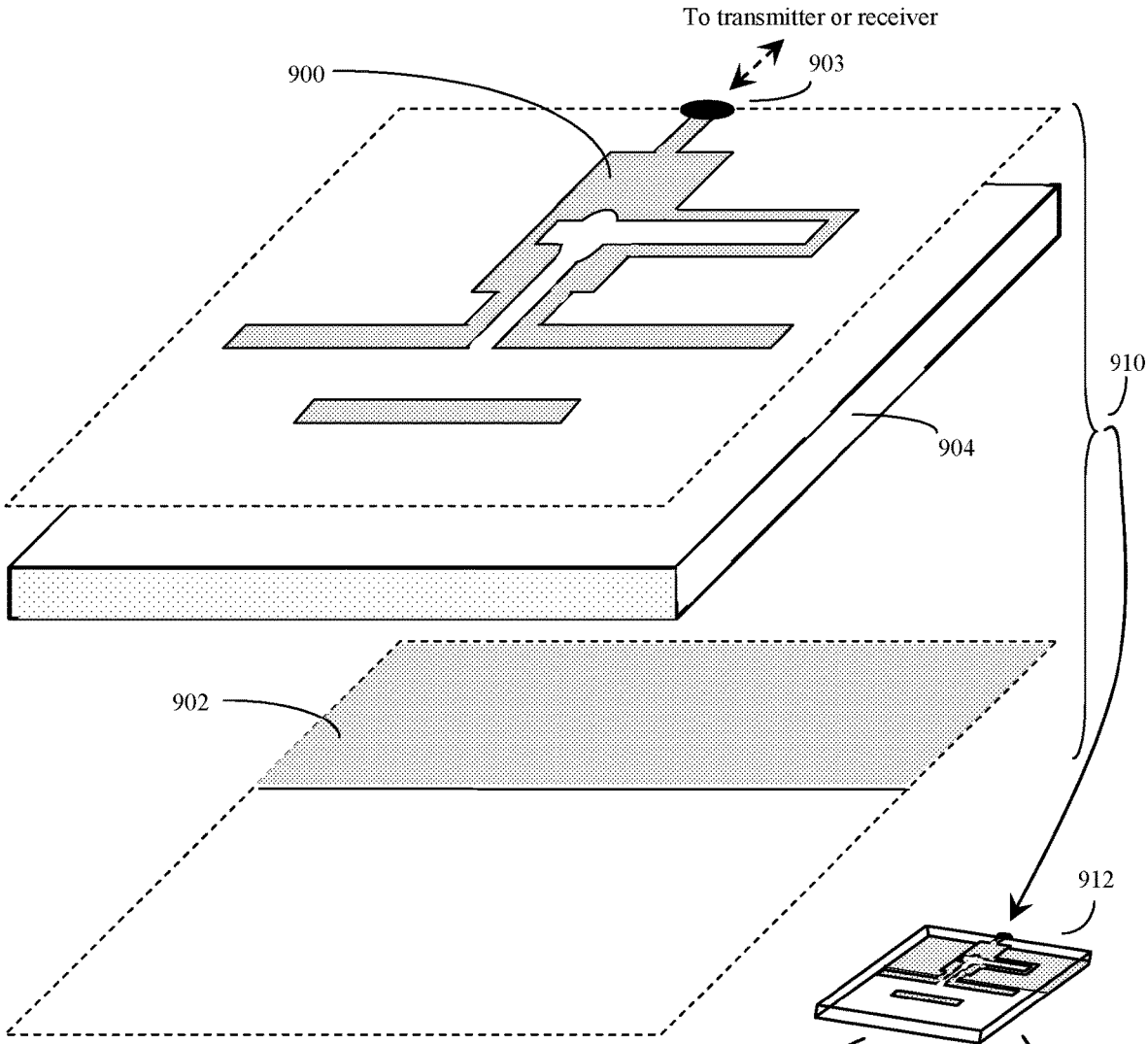
FIGS. 9A and 9B show another example of how two or more flat antennas can be configured to form polarized antenna sets by arranging at least one polarized antenna on a first surface and another polarized antenna onto a second surface at a non-zero angle relative to the first polarized antenna.
Figure 9B:
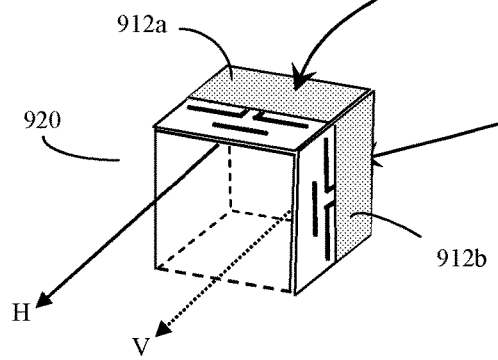

Note that in FIG. 7B (720), FIG. 9B (920), and FIG. 11B (920), the antenna system that is shown has polarized antenna sets where at least one first polarization mode antenna element (e.g. 712*a* or 912*a*) is on a first surface, and the at least one second polarization mode antenna element is (e.g. 712*b* or 912*b*) on a second surface. In these examples, this first surface may, in some embodiments, both intersect with and form a non-zero three dimensional angle (such as 90 degrees or other angle) with respect to the second surface. Note however, that the surfaces may but do not necessarily have to physically intersect. For example, the various surfaces could be placed in a holding arrangement that maintains the non-zero three dimensional angles, but holds the various surfaces physically separate from each other.

A substantial number of other antenna types or designs may also be used in this second major embodiment as well. Other suitable antenna design types, suitable for the various antenna elements in various polarization modes, include dipole antennas, patch antennas, Quasi-Yagi antennas, spiral antennas, folded beverage antennas, tapered slot antennas, inverted-F antennas, c-slot antennas, and monopole antennas, and reflectarray antennas.

FIGS. 9A and 9B, for example, show how a different type of flat (and often printed) type of antenna, such as Quasi-Yagi dipole like antenna (912), can also be configured to form polarized antenna sets (920). This antenna can be formed by, for example, depositing conductive material (900) in a Quasi-Yagi dipole pattern on a first surface of a dielectric (904), and depositing a ground plane (902) on the second surface of the dielectric (904). The Quasi-Yagi microstrip can then be connected to a suitable wireless transmitter or receiver at junction (903).

Here again, at least one polarized antenna element on a first surface (912*a*), and another polarized antenna (912*b*) element on a second surface can be held in a non-zero angle relative to each other, and form an antenna set (920) similar to the previously shown Vivaldi antenna set (720). As before, each antenna element (912*a*), (912*b*) can be oriented in the same direction, and have roughly the same directionality (e.g. wireless beams oriented in the same direction, and with essentially the same dispersion pattern). This antenna element is shown in both an exploded diagram form (910) in FIG. 9A and in a smaller non-exploded diagram form (912) in FIG. 9B.

FIG. 10B shows a non-exploded diagram of the Quasi-Yagi antenna system (912) previously shown in FIGS. 9A and 9B. Regions where RF energy can be applied to this antenna from various wireless transmitters, or retrieved from the antenna system from various wireless receivers, are shown as the black oval (903). This non-exploded diagram is also shown on a smaller scale as well in FIG. 10A.

Returning to FIG. 9B, the various antenna elements (912*a*, 912*b*) are shown forming two sides of a cube, but as before, other configurations are also possible. As before, the structure (here a cube) is also substantially empty because it lacks at least some sides. The antenna set does little to obscure the free flow of light or air. Thus a plurality of such antenna sets can be combined to create an open lattice, such as is often used for many structural, artistic, and architectural purposes. In a preferred embodiment, at least 80% and preferably 90% or more of the lattice, when viewed in a direction that is perpendicular to the lattice plane or surface, will be open so as to allow light and optionally also air to pass freely through the antenna structure or lattice from that perpendicular direction. Thus, in this embodiment, the lattice or antenna structure will appear substantially open.

Note that in FIG. 9A, the conductive layer (902) is a ground plane. In general, for any polarization mode, the antenna elements can further comprise a ground plane formed from conducting ground plane material (902) that has been deposited onto a surface of a dielectric material (904) that is substantially opposite to the (conductive) antenna material (900).

Note also that in this example, the (conductive) antenna material (900) deposited on a first surface of a substantially flat dielectric material (904), and the conducting ground plane material 902) has been deposited on an opposite surface of the same dielectric material (904).

FIGS. 11A and 11B show how a plurality of antenna sets, such as the sets (720) and/or (920) previously shown in FIGS. 7 and 9, can be combined to create a substantially open lattice (1100), (1110). In some embodiments, if the various antennas elements in the substantially open lattice are coupled to phase adjusted transmitters or receivers, then the directionality (1102, 1112) of the various antenna element beams and corresponding antenna set beams can also be controlled by suitable phase adjustments.

As previously discussed, one advantage of this second main embodiment is that when viewed perpendicular to the hollow cores, the antenna system may be relatively invisible, and also allow for the free passage of air. This lends itself to a variety of inconspicuous designs.

FIGS. 12A and 12B depict a substantially open lattice type antenna inconspicuously mounted in different locations. In particular, FIGS. 12A and 12B illustrate a manner in which the substantially open lattice type antenna structure (e.g. 1100 or 1110), formed from antenna sets such as (720) and (920), can be inconspicuously mounted in many locations, such as on the windows (1202, 1204) of a building (1200). This effectively creates a series of window mounted antenna systems (lattices) (1212, 1214) that can, in this example, be oriented in different directions (1222, 1224).

As previously discussed, various methods may be used to orient the antenna sets in different directions. The antenna sets may be mounted on supports (such as windows 1202 and 1204) that point the antennas in different directions. Alternatively, the antenna system may be constructed using a mix of different antenna set types, such as a mix of the Vivaldi antenna set type (720) and the Quasi-Yagi antenna set types, where the different types may have different directionality. As a third method, the various transmitters or receivers connected to the various antenna sets may use phase array techniques to change the directionality of the various antenna sets.

Note that in FIGS. 12A and 12B, this open lattice type antenna system can be configured to also present, on a visual or aesthetic basis, a substantially uniform and generally also transparent appearance. Thus here as well, neither the utility of the windows (1202, 1204) to admit light and allow a view, nor the overall appearance of the building (1200), is significantly impacted. Once again, this type of system makes it easier to obtain permission to mount the antenna system in a wide variety of different locations.

FIGS. 13A and 13B show substantially open lattice antennas mounted in an alternate configuration. As shown in FIG. 13A, the substantially open lattice type antenna system may be mounted on a substantially cylindrical air conditioner or air intake fixture (1302) on top of a different building (1300). As shown in FIG. 13B, this may form an open lattice around the air conditioner (1304). Because the lattice (1304) is substantially open, the free exchange of air, and thus the utility of the fixture, are not substantially impacted, nor is the overall appearance of the building substantially impacted. This again makes it easier to obtain permission to mount the antenna system in a wide variety of different locations.

Notice that in this case, because the antenna system is built on a cylindrical support with essentially 360 degrees of coverage, here as well at least some of the plurality of differently polarized antenna sets (e.g. 720, 920) are further configured to transmit and receive radio waves over a plurality of different directions that differ with respect to other differently polarized antenna sets.

Thus in this configuration, and in other configurations, the antenna system is designed such that the plurality of different directions span up to 360 degrees on a horizontal plane (see 1310, 1312). In other configurations, this may span up to 360 degrees on a vertical plane as well (e.g. all angles covered). Within these overall antenna systems, the individual polarized directional antenna sets need not span this full range however. A more typical span of directions for individual polarized directional antenna sets may be up to about 90 degrees on the horizontal plane, and up to about 90 degrees on a vertical plane. However other possibilities are not disclaimed.

Figure 14:
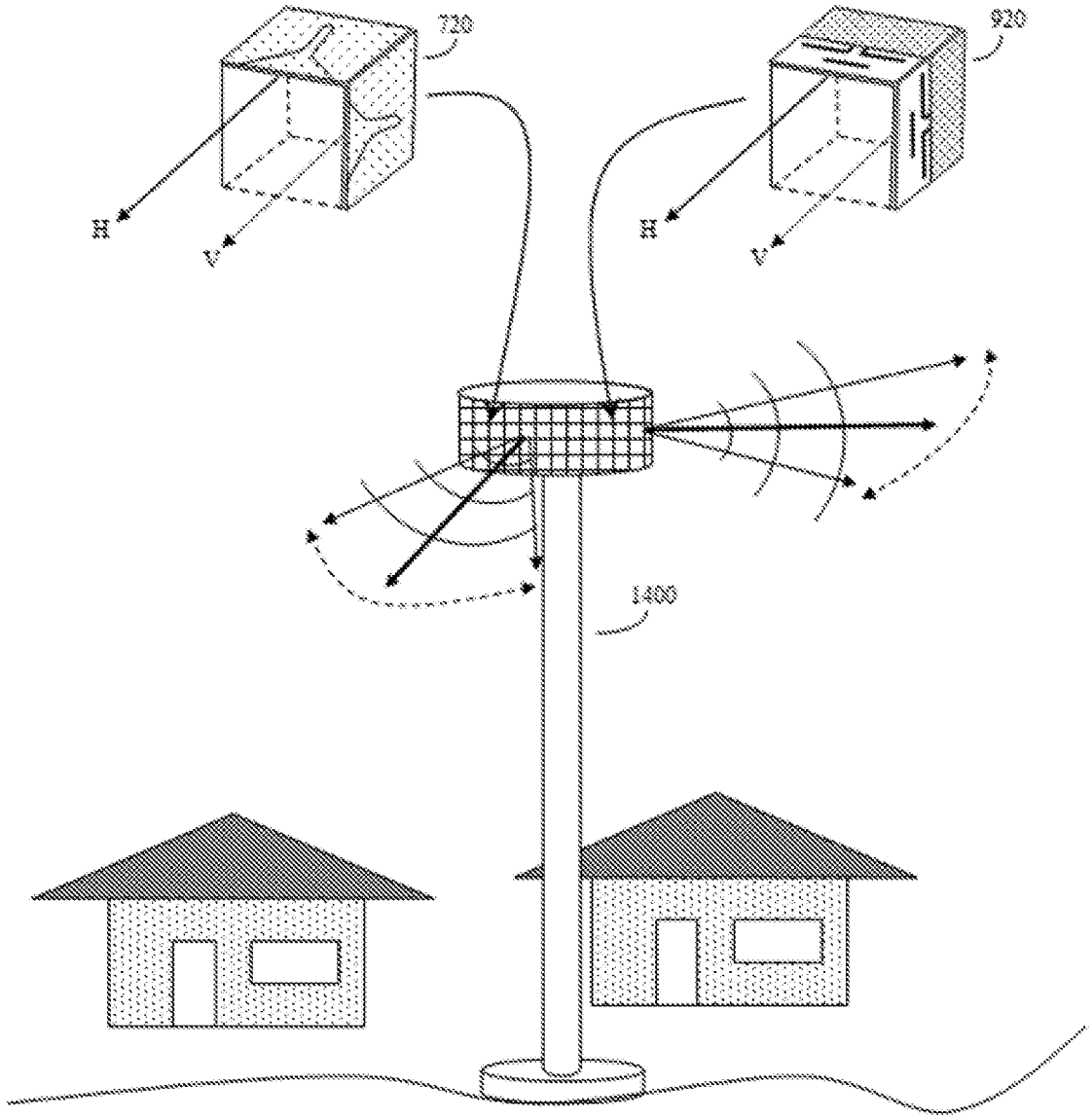
FIG. 14 depicts an alternate use example involving substantially open lattice antennas.

FIG. 14 depicts an alternate use example involving substantially open lattice antennas. In particular, FIG. 14 demonstrates one manner in which the substantially open lattice type antenna systems based on antenna sets (such as 720 and 920) can be mounted in other locations, such as street light fixtures (1400). Here again, because the antenna is configured to transmit light and to present a visually substantially uniform appearance, neither the utility of the street light fixture, nor its overall appearance, is significantly impacted.

This again makes it easier to obtain permission to mount the antenna system in a wide variety of different locations.

In the embodiment of FIG. 14 it may be helpful to use, particularly in dielectric layers, metamaterials to help further guide the directionality of the various antenna sets. Thus in some embodiments, at least some of the lattice type polarized antenna sets, or at least some of the first polarization mode antenna elements and some of the other polarization mode antenna elements may be further separated by metamaterials. As previously discussed, these metamaterials may be selected to, for example, confer at least partial wireless isolation between metamaterial separated polarized antenna sets, alter the polarization or directionality of the various antenna elements, and/or confer at least partial wireless isolation between metamaterial separated first polarization mode antenna elements and said at least one second polarization mode antenna elements. Alternatively, the metamaterials may be selected to confer additional directionality to the various antenna sets.

As previously discussed, in some embodiments, this second primary embodiment may also be used for DAS type distributed antenna systems as well. Here also, the antenna system may be configured to transfer wireless signals inside and outside (regions of poor wireless connectivity) of a structure by disposing at least some of the polarized antenna sets as outside antenna sets to receive and transmit wireless signals outside of the structure. Other polarized antenna sets may be disposed as inside antenna sets to receive and transmit wireless signals inside of the structure. These outside and inside antenna sets may be connected by either passive direct electrical connections (e.g. to implement a passive DAS system), or by active amplification and/or frequency shifting connections (e.g. to implement an active DAS system). Thus regions with poor wireless connectivity inside a structure may be achieve improved wireless performance.

For this second major embodiment as well, in some implementations the antenna system may further comprise at least one wireless transceiver (e.g. an LTE transceiver, OTFS transceiver, and the like), at least one computer processor, and memory. In this embodiment, this at least one wireless transceiver, at least one computer processor, and memory may be further used to adjust the various phases of the various wireless signals transmitted or received by the various polarized antennas sets so as to further control the directionality of the antenna system.

Figure 15:
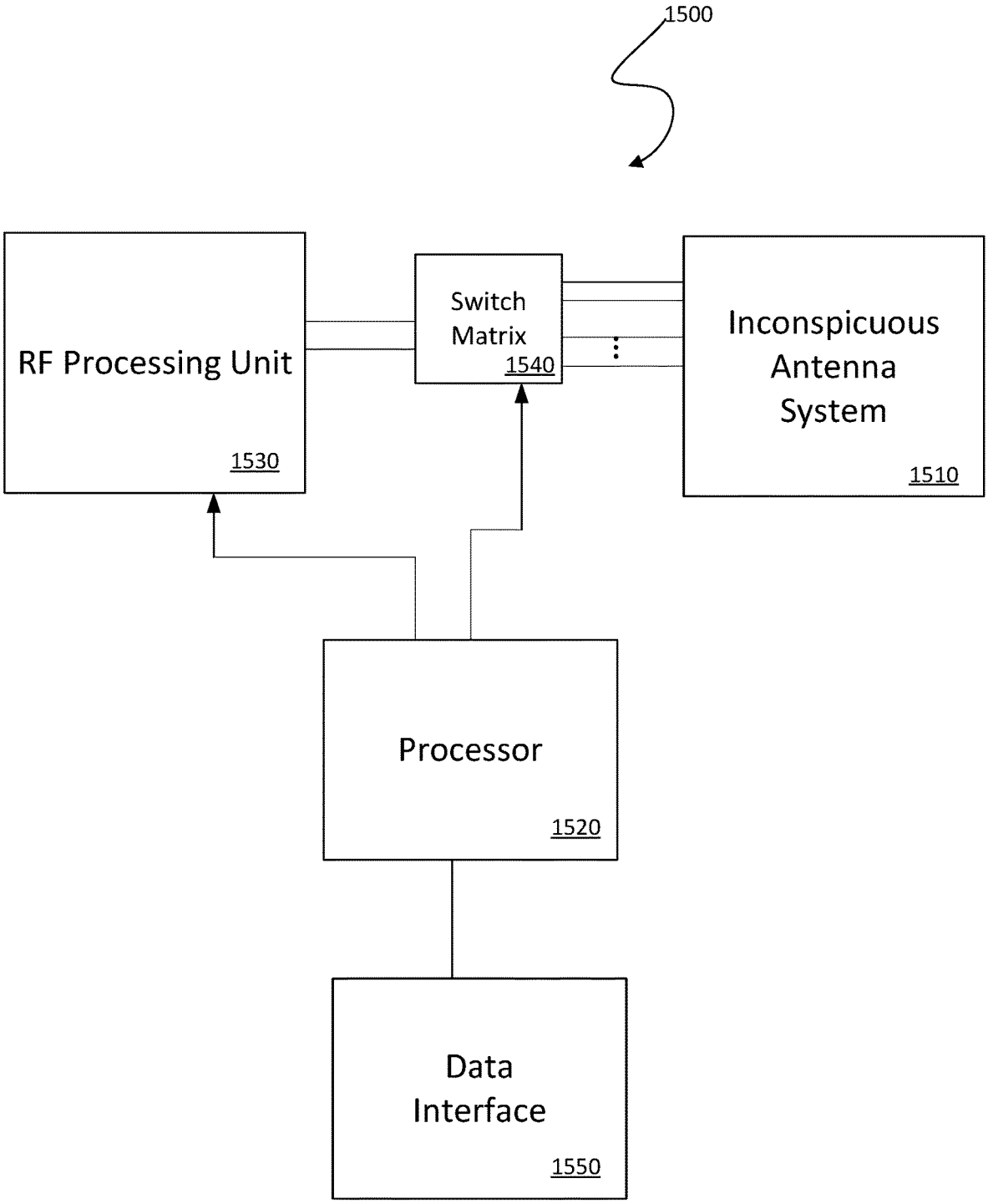
FIG. 15 provides a block diagrammatic representation of a wireless module or device incorporating an inconspicuous antenna system.

FIG. 15 provides a block diagrammatic representation of a wireless module or device 1500 incorporating an inconspicuous antenna system 1510 configured in the manner described herein. As shown, the wireless device includes a data interface 1550 configured to receive a data signal, typically from an external source. The received data signal may be encoded or otherwise processed by a processor 1520 and the result provided to an RF processing unit 1530, which will typically include a radio signal modulator and demodulator. The modulated signal may be provided, by an optional switch matrix 1540, to the inconspicuous antenna system.

The switch matrix may, under the control of the processor 1520, select all or a group of the antenna sets within the inconspicuous antenna system 1530 to radiate the modulated signal from the RF processing unit and/or to receive radio signals.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. Although various modules in the different devices are shown to be located in the processors of the device, they can also be located/stored in the memory of the device (e.g., software modules) and can be accessed and executed by the processors. Accordingly, the specification is intended to embrace all such modifications and variations of the disclosed embodiments that fall within the spirit and scope of the appended claims.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded into one or more different computers or other processors to implement various aspects of the present disclosure as discussed above.

The terms "program" or "software" or "code" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A dual polarized antenna system, the system comprising:

a first antenna set formed from a substantially optically transparent conducting material, the first antenna set including:

a first polarization mode antenna element radiating in a first polarization in a first direction, the first polarization mode antenna element including a first antenna element disposed in an element layer deposited on a surface of a first layer of substantially transparent dielectric material, a first feed line disposed in a feed line layer deposited on a surface of a second layer of substantially transparent dielectric material different from the first layer of substantially transparent dielectric material, a second polarization mode antenna element radiating in a second polarization in substantially the first direction wherein the first polarization is different from the second polarization, the second polarization mode antenna element including a second antenna element disposed in the element layer; and a second antenna set formed from the substantially optically transparent conducting material, the second antenna set including:

a third polarization mode antenna element radiating in a third polarization in a second direction different from the first direction, the third polarization mode antenna element including a third antenna element disposed in the element layer, a second feed line disposed in the feed line layer, a fourth polarization mode antenna element radiating in a fourth polarization in substantially the second direction wherein the third polarization is different from the fourth polarization, the fourth polarization mode antenna element including a fourth antenna element disposed in the element layer.

2. The antenna system of claim 1 wherein the first polarization is the same as the third polarization and the second polarization is the same as the fourth polarization.

3. The antenna system of claim 2 wherein the first polarization is a horizontal polarization and wherein the second polarization is a vertical polarization.

4. The antenna system of claim 1 wherein the first antenna set is formed from multiple layers and each layer is configured such that when the layers are overlaid an upper surface of the antenna set presents a substantially uniform visual optical absorbance.

5. The antenna system of claim 1, wherein the second layer of substantially optically transparent dielectric material is mounted on an adhesive backing configured to enable the second layer of substantially optically transparent dielectric material to adhere to a support surface.

6. The antenna system of claim 1, wherein the first polarization mode antenna element comprises a multilayer patch antenna, the multilayer patch antenna including:

a ground plane formed from the optically transparent conducting material and deposited on a surface of at third layer of substantially transparent dielectric material.

7. A dual polarized antenna system, the system comprising:

a first antenna set formed from a substantially optically transparent conducting material deposited on a surface of a first portion of substantially optically transparent dielectric material, the first antenna set including:

a first polarization mode antenna element radiating in a first polarization in a first direction, a second polarization mode antenna element radiating in a second polarization in substantially the first direction; and a second antenna set formed from the substantially optically transparent conducting material deposited on a surface of a second portion of substantially optically transparent dielectric material, the second antenna set including:

a third polarization mode antenna element radiating in a third polarization in a second direction different from the first direction, a fourth polarization mode antenna element radiating in a fourth polarization in substantially the second direction;

wherein the first polarization mode antenna element comprises a multilayer patch antenna, the multilayer patch antenna including:

a first layer of the optically transparent dielectric material;

a ground plane formed from the optically transparent conducting material and deposited on a surface of the first layer of the optically transparent dielectric material;

a second layer of the optically transparent dielectric material;

a first antenna patch formed from the optically transparent conducting material and deposited on a surface of the second layer of the optically transparent dielectric material;

wherein the multilayer patch antenna further includes:

a third layer of the optically transparent dielectric material, the third layer of the optically transparent dielectric material being interposed between the first layer of the optically transparent dielectric material and the second layer of the optically transparent dielectric material;

a feed line formed from the optically transparent conducting material and deposited on a surface of the third layer of the optically transparent dielectric material.

8. The antenna system of claim 1, further including:

a processor;

a memory including program code which, when executed by the processor, causes the processor to actively adjust a phase of wireless signals transmitted or received by at least one of the first antenna set and the second antenna set so as to change at least one of the first direction and the second direction.

9. The antenna system of claim 1, wherein the first feed line is of a first length and the second feed line is of a second length and wherein the first length is selected based upon the first direction and the second length is selected based upon the second direction.

10. An antenna system comprising:

a plurality of differently polarized antenna sets;

at least some of said differently polarized antenna sets each comprising at least one first polarization mode antenna element coupled with at least one second polarization mode antenna element respectively configured to radiate in first and second polarization modes and in first and second directions wherein the first direction is substantially the same as the second direction and wherein the first polarization mode is different from the second polarization mode;

wherein for the at least some of said differently polarized antenna sets, said at least one first polarization mode antenna element and said at least one second polarization mode antenna element are formed from a conducting antenna material;

wherein said at least one first polarization mode antenna element includes a first antenna element disposed in an element layer deposited on a surface of a first layer of substantially transparent dielectric material and wherein said at least one second polarization mode antenna element includes a second antenna element disposed in the element layer, wherein said at least one first polarization mode antenna element and said at least one second polarization mode antenna element are addressed by a feed line disposed in a feed line layer deposited on a surface of a second layer of substantially transparent dielectric material different from the first layer of substantially transparent dielectric material, and wherein said conducting antenna material is a substantially transparent conducting material.

11. The antenna system of claim 10, wherein different ones of said plurality of differently polarized antenna sets are further configured to transmit and receive radio waves over a plurality of different directions.

12. An antenna system comprising:

a plurality of differently polarized antenna sets;

each polarized antenna set comprising at least one first polarization mode antenna element coupled with at least one second polarization mode antenna element wherein said at least one first polarization mode antenna element and said at least one second polarization mode antenna element respectively radiate in a first polarization mode and a second polarization mode in substantially same directions so as to obtain substantially similar wireless coverage in the first polarization mode and the second polarization mode wherein the first polarization mode is different from the second polarization mode;

wherein one or more of said plurality of differently polarized antenna sets are further configured to transmit and receive radio waves in a first direction and other of said plurality of differently polarized antenna sets are further configured to transmit and receive radio waves in a second direction;

wherein for one or more of said polarized antenna sets, said at least one first polarization mode antenna element and said at least one second polarization mode antenna element are formed from a conducting antenna material;

wherein said at least one first polarization mode antenna element includes a first antenna element disposed in an element layer deposited on a surface of a first layer of substantially transparent dielectric material and wherein said at least one second polarization mode antenna element includes a second antenna element disposed in the element layer, wherein said at least one first polarization mode antenna element and said at least one second polarization mode antenna element are addressed by a feed line disposed in a feed line layer deposited on a first surface of a second layer of substantially transparent dielectric material different from the first layer of substantially transparent dielectric material, and wherein said conducting antenna material is a substantially transparent conducting material.

13. The antenna system of claim 12, wherein said conducting antenna material comprises a composition of Indium Tin Oxide, graphene, carbon nanotubes, aluminum gallium or indium doped zinc oxide, transparent conducting polymers, or other substantially transparent conducting material.

14. The antenna system of claim 12, wherein said substantially transparent dielectric material comprises one or more thin flexible materials or one or more thicker non-flexible materials.

15. The antenna system of claim 12, wherein said substantially transparent dielectric material is mounted on an adhesive backing configured to enable said dielectric material to adhere to a support surface, thereby adhering said antenna system to said support surface.

16. The antenna system of claim 12, wherein any of said first polarization mode antenna elements or said second polarization mode antenna elements are selected from any of dipole antennas, patch antennas, Quasi-Yagi antennas, spiral antennas, folded beverage antennas, tapered slot antennas, inverted-F antennas, c-slot antennas, and monopole antennas, and reflectarray antennas.

17. The antenna system of claim 12, wherein any of said first polarization mode antenna elements or said second polarization mode antenna elements further comprise a ground plane formed from conducting ground plane material that has been deposited onto a second surface of the second layer of substantially transparent dielectric material wherein the second surface is substantially opposite to the first.

18. The antenna system of claim 12, wherein said first surface of the second layer of substantially transparent dielectric material is a substantially flat surfaced, and wherein a ground plane formed from conducting ground plane material is deposited on an opposite surface of the second layer of substantially transparent dielectric material.

19. The antenna system of claim 17, wherein said conducting ground plane material and said-dielectric material are substantially transparent but with visually apparent absorbance or optical depth, and wherein a pattern of said conducting ground plane material and said antenna elements and any antenna feed lines are chosen so as to produce a transparent surface with substantially uniform visual optical absorbance or optical depth over nearly all of the surface.

20. The antenna system of claim 12 wherein an angle between the first direction and the second direction spans up to 360 degrees in a horizontal plane and up to 360 degrees in a vertical plane.

21. The antenna system of claim 12, wherein at least some of said polarized antenna sets, or at least some of said first polarization mode antenna elements and said at least one second polarization mode antenna elements, are further separated by, have an under layer, or have an over layer of metamaterial selected to confer any of:

a) at least partial wireless isolation between metamaterial separated polarized antenna sets; or b) at least partial wireless isolation between metamaterial separated first polarization mode antenna elements and said at least one second polarization mode antenna elements; or c) alter the polarization of at least some antenna elements in said antenna sets; or d) alter the directionality of at least some antenna elements or at least some antenna sets.

22. An antenna system comprising:

a plurality of differently polarized antenna sets;

each polarized antenna set comprising at least one first polarization mode antenna element coupled with at least one second polarization mode antenna element wherein said at least one first polarization mode antenna element and said at least one second polarization mode antenna element respectively radiate in a first polarization mode and a second polarization mode in substantially same directions so as to obtain substantially similar wireless coverage in the first polarization mode and the second polarization mode;

wherein one or more of said plurality of differently polarized antenna sets are further configured to transmit and receive radio waves in a first direction and other of said plurality of differently polarized antenna sets are further configured to transmit and receive radio waves in a second direction;

wherein for one or more of said polarized antenna sets, said at least one first polarization mode antenna element and said at least one second polarization mode antenna element are formed from a conducting antenna material that has been deposited onto a surface of a dielectric material;

wherein said conducting antenna material is a substantially transparent conducting material; and wherein said dielectric material is a substantially transparent dielectric material, wherein said antenna system is further configured as a DAS distributed antenna system and configured to transfer wireless signals inside and outside of a structure by disposing at least some of said polarized antenna sets as outside antenna sets to receive and transmit wireless signals outside of said structure, disposing at least some of said polarized antennas as inside antenna sets to receive and transmit wireless signals inside of said structure, and connecting said outside and inside antenna sets by any of passive direct electrical connections to implement a passive DAS system, or by active amplification and/or frequency shifting connections to implement an active DAS system.

23. The antenna system of claim 12, wherein said antenna system further comprises at least one wireless transceiver, at least one computer processor, and memory;

further using said at least one wireless transceiver, at least one computer processor, and memory to actively adjust a phase of wireless signals transmitted or received by said plurality of polarized antenna elements so as to further control the directionality of said antenna system.

24. The antenna system of claim 12, wherein a plurality of antenna elements in said antenna system are further configured with either microstrips of varying length or as Rotman type lens arrangements configured to passively adjust a phase of wireless signals transmitted or received by said plurality of polarized antenna elements so as to further control the directionality of said antenna system.

25. The antenna system of claim 1 wherein the first antenna set is formed from layers of the substantially optically transparent conducting material mounted on at least the first layer of substantially transparent dielectric material and the second layer of substantially transparent dielectric material.

26. The antenna system of claim 10 wherein the at least some of said differently polarized antenna sets each include a ground plane formed from the optically transparent conducting material and deposited on a surface of a third layer of substantially transparent dielectric material.

* * * * *